United States Patent [19]

Hopkins, Jr.

[11] Patent Number: 4,513,545

[45] Date of Patent: Apr. 30, 1985

[54] APPARATUS FOR AND METHOD OF CONSTRUCTING, TRANSPORTING AND ERECTING A STRUCTURE OF TWO OR MORE STORIES COMPRISED OF A PLURALITY OF PREFABRICATED CORE MODULES AND PANELIZED ROOM ELEMENTS

[76] Inventor: George D. Hopkins, Jr., 1546-48 Magazine St., New Orleans, La. 70130

[21] Appl. No.: 419,732

[22] Filed: Sep. 20, 1982

[51] Int. Cl.[3] ..... E04H 1/00

[52] U.S. Cl. ..... 52/79.1; 52/745

[58] Field of Search ..... 52/79.1, 236.3, 221, 52/79.14, 236.5, 236.6, 745

[56] References Cited

U.S. PATENT DOCUMENTS

| | | | |
|---|---|---|---|
| 2,168,725 | 8/1939 | Whelan . | |
| 3,292,327 | 12/1966 | Van Der Lely | 52/79.14 X |
| 3,422,582 | 1/1969 | Van Der Lely . | |
| 3,585,767 | 3/1969 | Lindingo et al. | 52/79 |
| 3,593,469 | 7/1971 | Wall | 52/27 |
| 3,601,937 | 8/1971 | Campbell | 52/79.1 X |
| 3,694,973 | 10/1972 | Unger | 52/79.1 X |
| 3,727,753 | 4/1973 | Starr et al. | 52/79 X |
| 3,729,875 | 5/1973 | Felson | 52/79 |
| 3,768,221 | 10/1973 | Fuller | 52/221 |
| 3,800,493 | 4/1974 | Livingston | 52/745 |
| 3,810,335 | 5/1974 | McCrillis et al. | 52/79 |
| 3,831,327 | 8/1974 | McCrillis et al. | 52/79.1 |
| 3,862,534 | 1/1975 | Coletti | 52/79.1 X |
| 4,045,937 | 9/1977 | Stucky | 52/745 |
| 4,050,215 | 9/1977 | Fisher | 52/79.14 X |
| 4,221,441 | 9/1980 | Bain | 52/79.1 X |

FOREIGN PATENT DOCUMENTS

| | | | |
|---|---|---|---|
| 2544709 | 4/1977 | Fed. Rep. of Germany | 52/79.1 |
| 991685 | 10/1951 | France | 52/79.14 |

*Primary Examiner*—Carl D. Friedman
*Attorney, Agent, or Firm*—Keaty & Keaty

[57] ABSTRACT

A prefabricated structure of at least two stories comprised of a vertically stacked modular core and interlocking system of panelized component room elements erected upon a monolithic concrete slab. The subject modular core is composed of three units each built upon a base pallet and featuring pre-finished walls, cabinets, appliances, fixtures, floor coverings and containing an integrated plumbing, mechanical and electrical system which services the dwelling. Said core modules and plurality of room elements are manufactured utilizing mass production techniques and transported to the building site. The lower core module contains a kitchen, central hallway, a portion of the staircase, and powder room facilities. Panelized room elements appended to the front and rear of the lower core form a living room and dining/den area. The middle core unit contains a bath with laundry facilities and corridor for internal circulation between two bedrooms subsequently formed by panelized room elements appended to the front and rear sides. The upper core module forms a floored attic area containing heating and air-conditioning equipment and hot water heater. The concrete slab foundation contains a preformed central depression to receive the lower core module thus providing a uniform interior floor surface by receiving pallet of said module. Said preformed depression branches outward from the core extending to the rear exterior wall in the form of a trough which enables the subsequent connection of plumbing drain pipes, water lines and electrical conduit following erection of the structure. A complex of similar dwelling units can be established by placing a plurality of said structures side-by-side, in a linear configuration, thus forming a row of townhouses or offices.

38 Claims, 39 Drawing Figures

APPARATUS FOR AND METHOD OF CONSTRUCTING, TRANSPORTING AND ERECTING A STRUCTURE OF TWO OR MORE STORIES COMPRISED OF A PLURALITY OF PREFABRICATED CORE MODULES AND PANELIZED ROOM ELEMENTS

DESCRIPTION OF THE PRIOR ART

Prefabricated construction systems for a dwelling unit utilizing manufacturing techniques are well known in the art of building. The following U.S. Patents are pertinent to this invention, but are differentiated by conceptual design, materials, methods of construction, size, arrangement, assembly, erection techniques, mechanical, electrical and plumbing systems, the embodiments of this invention providing advantages over the arrangements taught in the following patents.

The subject invention differs from U.S. Pat. No. 2,168,725 in that the structural support system is wood frame, not metal and concrete; a single wood joist system not stacked unitary assemblages containing double plane floors and ceilings between said elements; said units contain a stairway, powder room, and hallway for internal circulation integrated into the module where none are provided in the other invention; mechanical equipment down-feeds from the uppermost stacked module not from a sub-terrainian unitary prefabricated assemblage.

This invention differs from U.S. Pat. No. 3,422,582 in that it is designed as an attached structure in a row of similar buildings not an individual single family residence; the structural support system for this invention is wood frame not steel pipe columns; the floor plan features a central kitchen having a single common plumbing wall with a bathroom and toilet area above, not a corner kitchen on a ground floor and central or corner bath without toilet on an upper floor; this invention has a floored attic area for mechanical equipment and storage where none has been provided in the other invention.

This invention differs from U.S. Pat. No. 3,585,767 in that the subject invention is of wood frame construction forming rooms the interior of which are covered with gypsum or plywood wall materials not, elognated sheet metal elements substantially of U-shaped cross section spot-welded to form a wall; the subject invention embodies a plurality of modules cooperating to form a stacked vertical core for a structure not a single pre-fabricated room unit design.

The subject invention is differentiated from U.S. Pat. No. 3,593,469 in that it is comprised of a plurality of modules cooperating with panelized wall elements to form a structure, not a single two-story prefabricated service module; the subject invention embodies the entire facility required for kitchen services, not a single wall of appliances and fixtures requiring structural appendages to complete the kitchen; the subject invention includes a permanently installed bathtub/shower, not plumbing connections for a tub to be installed which projects into a subsequently installed structural appendage; this invention locates the electrical distribution panel in the kitchen, not in a powder room which violates many building codes; this invention places the hot water heater in the upper core module, not below a stair which violates many building codes; this invention utilizes PVC plumbing pipe with no-hub connections, not cast iron pipe.

The subject invention differs from U.S. Pat. No. 3,727,753 in that it embodies a lower core module comprising an integrated arrangement for kitchen, hallway, powder room and staircase to the second floor, not separate wall components for a kitchen having cantilevered appurtenances; the design of the subject invention incorporates load-bearing structural walls not, non-load-bearing partition walls; the subject invention is constructed upon a base pallet, not a subsystem devoid of a floor for installation in a building structure having a floor to support said unit; the ceiling for the subject invention is subsequently attached to the underside of the stacked middle core module, not recessed and expanding between planar side walls; this invention is shipped fully framed in final arrangement, not expanded from a condensed shipping package into final configuration; this invention cooperates with other core modules to receive air-conditioning, none have been provided for the other invention; this invention features a prefabricated floor installed at a location remote from the building site, no floor having been provided for the other system.

The subject invention is differentiated from U.S. Pat. No. 3,729,875 in that it is of load-bearing wood frame construction, not precast sections interlocked together on site; panelized floor, wall and roof elements interact with a stacked modular core to form the subject invention, not "L" shaped precast members forming segments of ceiling and wall, wall and floor, or corner walls respectively connected to fashion a structure.

This invention differs from U.S. Pat. Nos. 3,768,221, 3,800,493, and 3,810,335 in that the subject structure is comprised of a plurality of core modules and panelized room elements of wood frame construction, not a system of prestressed concrete pallets supported between load bearing concrete walls to form floors and ceilings.

This invention is differentiacted from U.S. Pat. No. 4,045,937 in that it is of structural wood frame construction, not a load bearing metal frame of vertically extending channels interacting with horizontal beams aligned with the channels of a plurality of floor panel members.

The subject invention differs from U.S. Pat. No. 4,048,769 in that it is of load bearing wood frame construction, not elongated box-shaped prefabricated sections having a framework of metal beams with cast concrete walls each having embedded metal stiffening bars.

BACKGROUND OF THE INVENTION

This invention was prompted by the need for affordable housing in the United States. Economic recession and long term interest rates exceeding seventeen percent per annum, together with high costs for conventional construction have made homeownership impossible for many Americans. Through techniques of prefabrication, utilizing a modular service core and system of panelized room elements, this invention is designed to enable the majority of construction efforts to transpire in a factory, removed from the building site. When assembled, said core modules and panelized room elements comprise a two story townhome with finished attic. Cost savings through mass production and prefabrication are anticipated due to reductions in cost of materials through volume purchasing, substantial interim construction financing savings as a result of a shortened construction period, alleviaton of delays due to inclement weather, and production costs which are not controlled by local labor conditions.

The plan of the subject structure is suitably flexible for utilization as a residential dwelling or office facility. A complex of similar units can be established by placing a plurality of said structures side-by-side, in a linear configuration, thus forming a row of townhomes or offices. Said units may be rented as apartments or offices, sold as condominiums or cooperatives, or deeded as individual dwellings depending upon local zoning ordinances.

SUMMARY OF THE INVENTION

A prefabricated modular core and system of panelized component room elements comprising a structure to be inhabited as a dwelling unit or commercial facility. Said modular core is composed of three separate modules which stack vertically upon a monolithic concrete slab and contain all mechanical equipment, plumbing fixtures and the electrical distribution system which services the structure. The subject core extends the entire lateral width of said sturcture having room elements appended to the front and rear on each of at least two floors. The lower core module, first floor level, contains a fully furnished kitchen including cabinets, double pan sink, dishwasher, disposal, electric range and ventilating hood; a central hallway; and a portion of the staircase to the second floor, same having a powder room below. The middle core module, second floor level, includes the hallway for internal circulation; a bathroom consisting of a fiberglass tub and shower, a toilet, a vanity, a linen closet and a facility comprising an electric clothes dryer and a washing machine. Vertical chases within said middle core module house supply and return-air ductwork for the central air-conditioning system. The upper core module, at the third floor level, forms a floored attic storage area enclosing said heating and central air-conditioning equipment and a hot water heater. Access to the upper core module (attic) is accomplished by means of a pull-down staircase/ladder mounted in the floor. The roof of said module forms a portion of the finished roof of the subject structure.

Rooms are appended to the modular core by attaching a system of prefabricated, panelized component room elements consisting of insulated, pre-wired wall, roof and floor panels. When forming exterior walls, said room elements contain pre-hung doors and windows and walls pre-finished on one side. Said panelized floor elements are designed to interlock horizontally with the structure of the modular core and span to the front and rear exterior load bearing walls. Said floor elements also form the first floor ceiling.

Panelized room elements forming second floor walls are set in place vertically on top of said panelized floor elements and fasten laterally to the stacked modular central core. The roof of the structure is formed by panelized room elements which are extended from the lower edge of the central core to both front and rear exterior walls, thus completing the basic dwelling unit. The underside of said roof element forms vaulted second floor ceilings.

A standardized eight foot dimension for the core modules and all room elements composing floor, wall and roof panels enables transportation to any site on conventional flat-bed trailers. This invention is distinguished from many modular units by dimensional compactness and utilization of standard material sizes. Therefore, the following savings are affected: shipping costs are reduced because special transportation equipment, wide-load highway permits and escort vehicles are not required; erection expenses are reduced by use of lightweight cranes; and labor and material costs are reduced through the use of standard size materials, thereby eliminating much waste and work effort.

An alternate method of fabricating second floor rooms involves the pre-assembly of panelized floor, wall, and roof elements as part of the manufacturing process prior to shipment to the building site. Through this approach, fully assembled and prefinished second floor room modules are transported from the factory and set in place by means of lightweight cranes in the subject structure upon the aforementioned load bearing first floor panelized room elements.

This invention teaches a technique for interlocking modular core units and panelized room elements for the subject structure that allows for the erection in all climates during any season. The rapid erection process, resulting in a water-tight structural enclosure within one work day, enables construction during a brief abatement of adverse weather conditions. Final plumbing connections and interior finishing are completed within the enclosed structure. The novel design of said core modules and configuration of the slab eliminates the necessity for plumbing and electrical site work until the structure has been totally erected. As a result, construction of the foundation slab is accelerated, the amount coordination of sub-contractors is reduced, the time interval between commencement of construction and completion of the enclosed structure is shortened, and construction completion activities on site are protected from the elements.

DESCRIPTION OF THE DRAWINGS

The subject invention will now be described in more detail with reference to the accompanying drawings in which.

DETAILED DESCRIPTION OF THE PRESENT INVENTION

Referring now to FIGS. 1–9, there can be seen the erection process, in its various stages of development, of a two story dwelling or office having an attic, which is the subject matter of the present invention. All core modules in wall, floor, and roof components of said dwelling or office of the present invention (hereinafter described) are made to standardized eight foot dimensions, thereby facilitating loading onto conventional flat-bed trailers or the like, thereby enabling all of said core modules and wall, floor and roof components thereof to be shipped to the construction site in a complete, pre-fabricated form and fully intact. Therefore, unlike many modular structures, the edifice of the present invention does not require wide-load highway permits, special escort vehicles or unusually large crains to set its units in place. Further, all of said core modules in wall, floor and roof components which comprise the edifice of the present invention can be set into place and erected by means of a lightweight crain (not shown), for example, thereby decreasing the time necessary for construction and decreasing the costs thereof.

Figures 1, 2, 3, 4, 5, 6, 7, 8, 9:
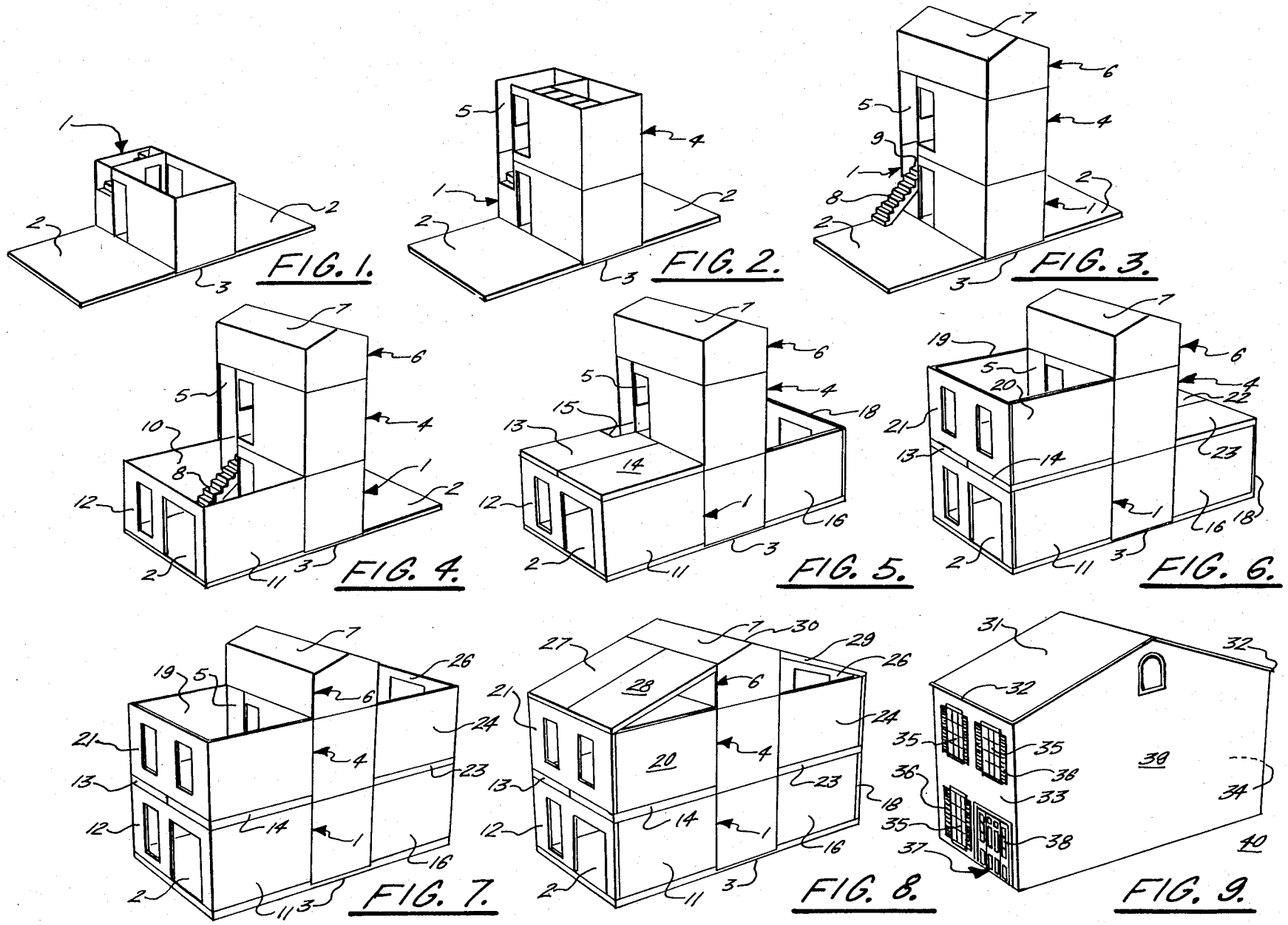
FIG. 1 is a perspective view of the monolithic slab for a structure of two or more stories having a prefabricated core comprised of a plurality of modules the first of which has been set in place.
FIG. 2 is a perspective view of the placement of the middle core module directly above the lower core module.
FIG. 3 is a perspective view of the placement of the upper core module upon the stacked lower and middle core modules.
FIG. 4 is a perspective view of the erection of the first floor panelized room elements forming the first of two ground floor rooms appended to the central core.
FIG. 5 is a perspective view of the erection of first floor panelized room elements forming the second of two ground floor rooms appended to the central core and the simulantenous placement of panelized floor elements completing the ceiling of the first room and forming the second story floor.
FIG. 6 is a perspective view of the erection of panelized room elements forming the first of two second floor bedrooms appended to the central core and simultaneous placement of panelized floor elements for a second bedroom.
FIG. 7 is a perspective view of the subject structure featuring the placement of second floor panelized room elements.
FIG. 8 is a perspective view of the subject structure depicting placement of the panelized roof elements.
FIG. 9 is a perspective view of the subject structure illustrating the finished exterior facade, roof, and side wall.

The structure shown in FIGS. 1–9 is in the form of a two story dwelling or office having an attic. As illustrated in FIG. 1, the prefabricated lower core module 1 is set in place for example, by means of a lightweight crane (not shown), at the building site laterally preformed slab depression 3 of a formed monolithic concrete slab 2 and recesses. The middle core module 4 is then stacked vertically above the lower core module 3 as shown in FIG. 2. Panelized hallway wall element 5 is set in place at the second floor level opposite the middle core module 4 thus completing the rectangular proportion and making the planar floor perimeter identical in form to that of the lower core module 1. As shown in FIG. 3, the subject panelized room element 5 combines with middle core module 4 in providing a uniform structural bearing surface upon which upper core module 6 is stacked vertically above the lower and middle core modules 1 and 4, respectively. The central roof 7 of the subject structure is formed by the top of upper core module 6. Preassembled stair component 8 is then set in place upon concrete slab 2 and attached to the lower core module 1, thus completing the staircase 9.

Referring now to FIG. 4, the next step in the erection process is the installation of panelized interior party wall elements 10 and 11 which are securely fastened to the concrete slab 2 and lower core module 1. Panelized exterior wall element 12 is then attached to the lateral end extremities of panelized interior party wall elements 10 and 11.

FIG. 5 depicts the placement of panelized floor elements 13 and 14 which interlock with the lower and middle core modules 1 and 4 and span outwardly to panelized exterior wall element 12 upon which said floor elements 13 and 14 structurally bear. FIG. 5 further illustrates a pre-fabricated notch 15 in panelized floor element 13 which provides head clearance above stair component 8 attached to staircase 9. Also shown in FIG. 5 is the placement of panelized interior party wall element 16 which is attached to slab 2 and lower core module 1. A corresponding party wall element (not shown) is attached to slab 2 and lower core module opposite wall element 16. Panelized exterior wall element 18 is then fastened to the lateral end extremities of interior party wall elements 16 and 17.

Referring now to FIG. 6, second floor panelized interior party wall elements 19 and 20 are respectively installed upon and fastened to panelized floor elements 13 and 14. The subject wall elements 19 and 20 are similarily secured to the middle core module 4. The next step in the erection process is the placement of second floor panelized exterior wall element 21, which is fastened on its bottom end to the upper side of floor elements 13 and 14, and on either end to the lateral end extremities of second floor panelized interior party wall elements 19 and 20. Installation of panelized floor elements 22 and 23 occurs simultaneously above panelized interior party wall elements 16 and 17, wherein floor elements 22 and 23 interlock with lower and middle core modules 1 and 2 and span outwardly to panelized exterior wall element 18 upon which floor elements 22 and 23 structurally bear.

FIG. 7 illustrates the placement of second floor panelized interior party wall element 24, which is fastened to panelized floor element 23 on its bottom end and to middle core module 4 on its inner end. A corresponding party wall element (not shown) is similarly fastened to panelized floor element 22 on its bottom end and attached to middle core module 4 on its inner end, opposite wall element 24. Second floor panelized exterior wall element 26 is then fastened to the outer end extremities of second floor interior party wall elements 24 and its corresponding counterpart (not shown).

Referring now to FIG. 8, four panelized roof elements 27, 28, 29, and 30 are installed at an angle extending downwardly and outwardly from the lower edge of the central roof 7, upper core module 6, to the top edges of both front and rear second floor panelized exterior wall elements 21 and 26. External roofing material 31 in the form of asbestos, asphalt, slate, metal, fiberglass shingles, or other suitable waterproofing material is applied to the upper surface of the central roof 7 and panelized roof elements 27, 28, 29 and 30 as illustrated in FIG. 9. Said roofing material 31 may be applied either during the factory pre-fabrication process or at the building site following erection of the basic structure. Gutters 32 are installed at the lowest edges of the roofing at the point of intersection of the finished facade 33 and finished rear elevation 34. Finished facade 33 and rear elevation 34 are composed of weatherboards, wood siding, vertical or horizontal tongue and groove siding, aluminium siding, stucco, brick or other suitable building material. FIG. 9 further depicts fenistration of the facade 33 composed of double-hung windows 35 having operable or fixed shutters 36, a wood or metal front entrance door 37 having side lites 38. An alternate design for the front entrance omits side lites 38 and features two similar front entrance doors 37 hung as a pair of french doors. Also shown in FIG. 9 is finished side wall 39 of the subject structure which provides a permanent weather-proof surface covering the ends of lower core module 1, middle core module 4, upper core module 6, panelized interior party wall elements 11 and 16, and second floor panelized interior party wall elements 20 and 24. The subject finished side wall 39 in FIG. 9 is composed of one or more of the materials identified as constituting finished facade 33 and finished rear elevation 34. Finished side wall 39 reflects the treatment of the side wall of building 40 in a row of similar structures 40 and 41 which FIG. 10 illustrates in plan view.

Figure 10:
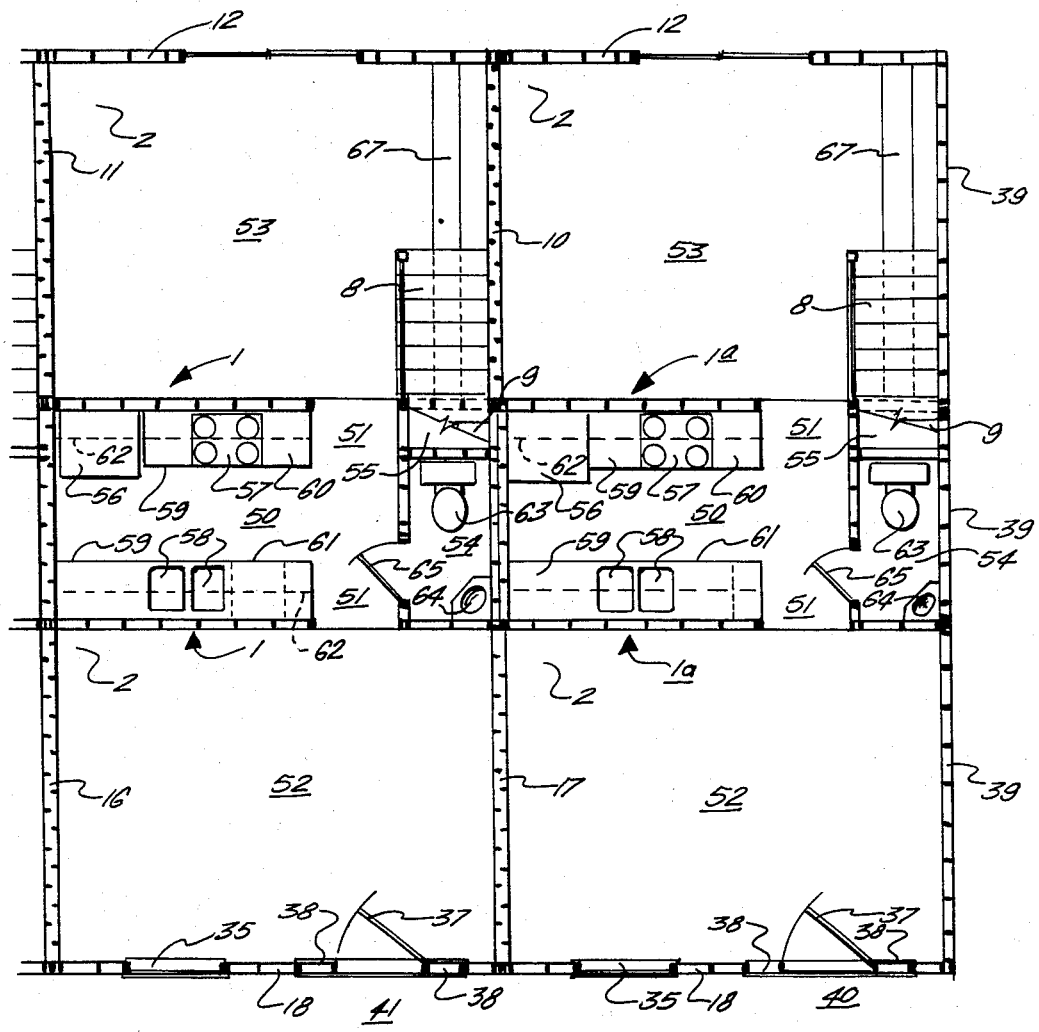
FIG. 10 is a sectional plan view of the first floor of the structure shown in FIGS. 1–9.

FIG. 10 depicts the first floor of the subject structures in plan view showing the central location of lower core module 1 which extends laterally across the width of structures 40, 41. The placement of similar lower core module 1 in structure 40 abuts said lower core module 1 in structure 41 forming a double central first floor party wall 42. The first floor plan of structures 40 and 41 feature within lower core modules 1, **1*a* a central kitchen 50 having a corridor for internal circulation 51 connecting appended living area 52 and den/dining area 53. Also contained within lower core modules 1, 1*a* are powder room 54 and service chase 55**.

As can also be seen in FIG. 10, the central kitchen 50 contains a refrigerator 56, electric range 57, double-pan sink 58, base cabinets/drawers 59 said having countertops 60, and a below-counter dishwasher 61, and upper cabinets 62. The powder room 54 contains a toilet 63, lavatory 64, and powder room door 65 which closes for privacy.

FIG. 10 further shows a preformed trough depression 67 in monolithic concrete slab 2 below stair component 8 which extends from service chase 55 across the floor of den/dining area 53 to the outermost edge of said slab 2 below panelized exterior wall element 12. The subject preformed trough depression 67 provides a channel for connecting external utilities to lower core modules 1, **1*a*. FIG. 10 further illustrates in plan view the location of stair component 8 which attaches to staircase 9 located in lower core module 1, thereby facilitating access to second floor hallway 66 of structures 40 and 41, as depicted in FIG. 11**.

Figure 11:
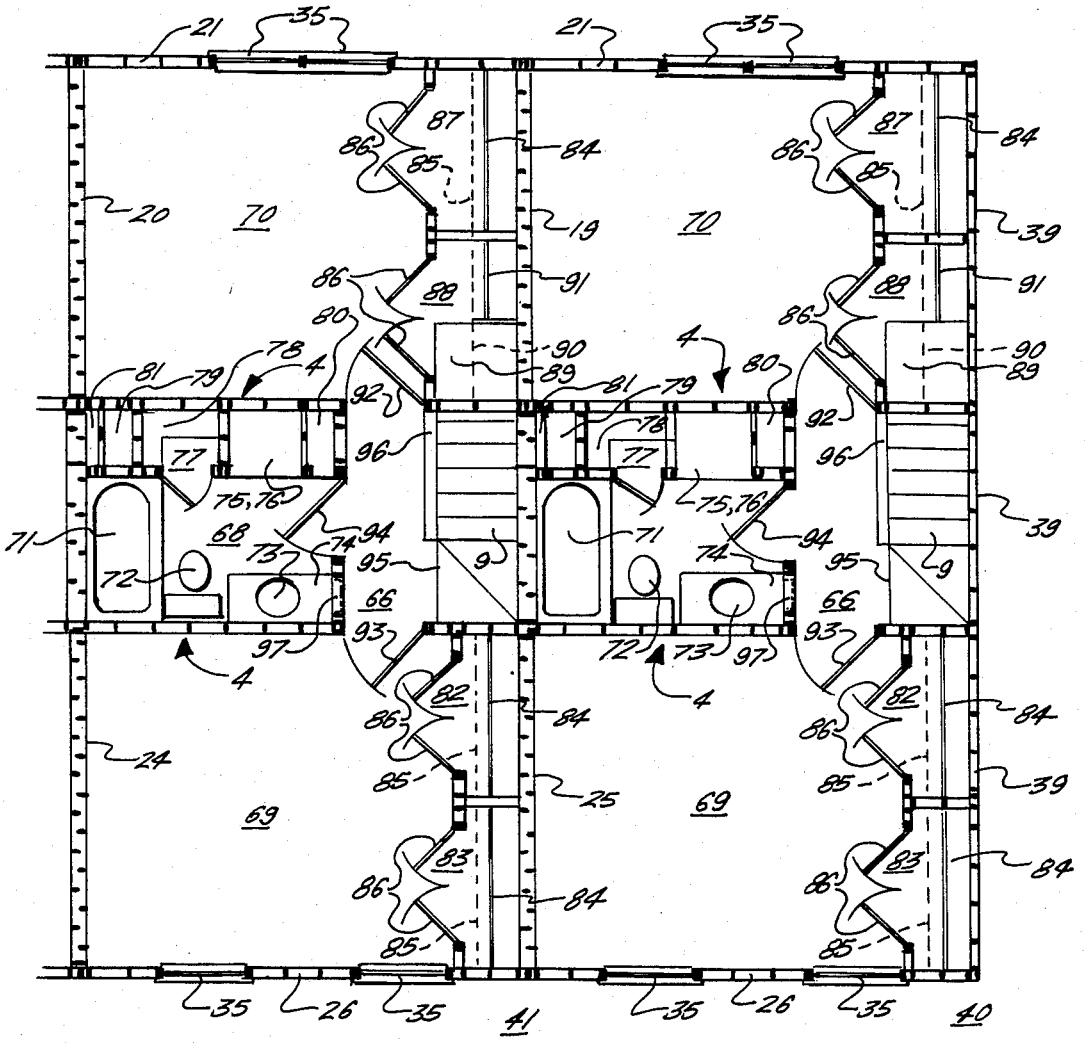
FIG. 11 is a sectional plan view of the second floor of the structure shown in FIGS. 1–9.

FIG. 11 also illustrates the second floor of the subject structures 40 and 41 in plan view, wherein is depicted centrally located middle core module 4 containing bathroom 68 having two appended rooms, master bedroom 69 and bedroom 70. As an integral part of middle core module 4, bathroom 68 contains a bathtub/shower 71, toilet 72, lavatory 73 mounted in vanity base cabinet 74, laundry facilities for a stacked electric clothes dryer 75 and washing machine 76, linen closet 77 with shelves 78, and a medicine cabinet 97. Also located within middle core module 4 are the air-conditioning supply chase 79, return-air chase 80, and electrical wiring chase 81. Said chase spaces extend vertically through middle core module 4, thereby facilitating the inter-connection of the corresponding services between lower core module 1 and upper core module 6.

The aforementioned appendage to middle core module 4 which forms master bedroom 69 contains at least two windows 35 and has two closets 82 and 83 each having a hanging rod 84 and shelf 85. Said closets each feature a pair of french doors 86 which enclose the contents. Bedroom 70 similarly contains two closets 87 and 88 each having an interior depth equal to the width of staircase 9. Closet 88 is placed directly above the prefabicated notch 15 in panelized floor element 13 and features a sloped partition 89 parallel to the incline of stairway component 8 and staircase 9 which allows head clearance when climbing staircase 9. The subject closet 88 contains one or more shelves 90 and a hanging rod 91. Closet 87 contains a hanging rod 84 and shelf 85. Fenistration for bedroom 70 is included in second floor panelized exterior wall element 21 in the form of two double-hung windows 35 which abut at the center of said wall element 21. Bedroom 70 adjoins hallway 66 by means of passage door 92. Said hallway 66 provides interior circulation at the second floor level to master bedroom 69 through passage door 93 and to bathroom 68 through passage door 94. Egress from the second floor hallway 66 is by means of stairway 9. The head of the stair 95 occurs at the point at which the staircase 9 in lower core module 1 joins middle core module 4. Walled railing 96 provides a secure separation between said staircase 9 and second floor hallway 66.

Figure 12:
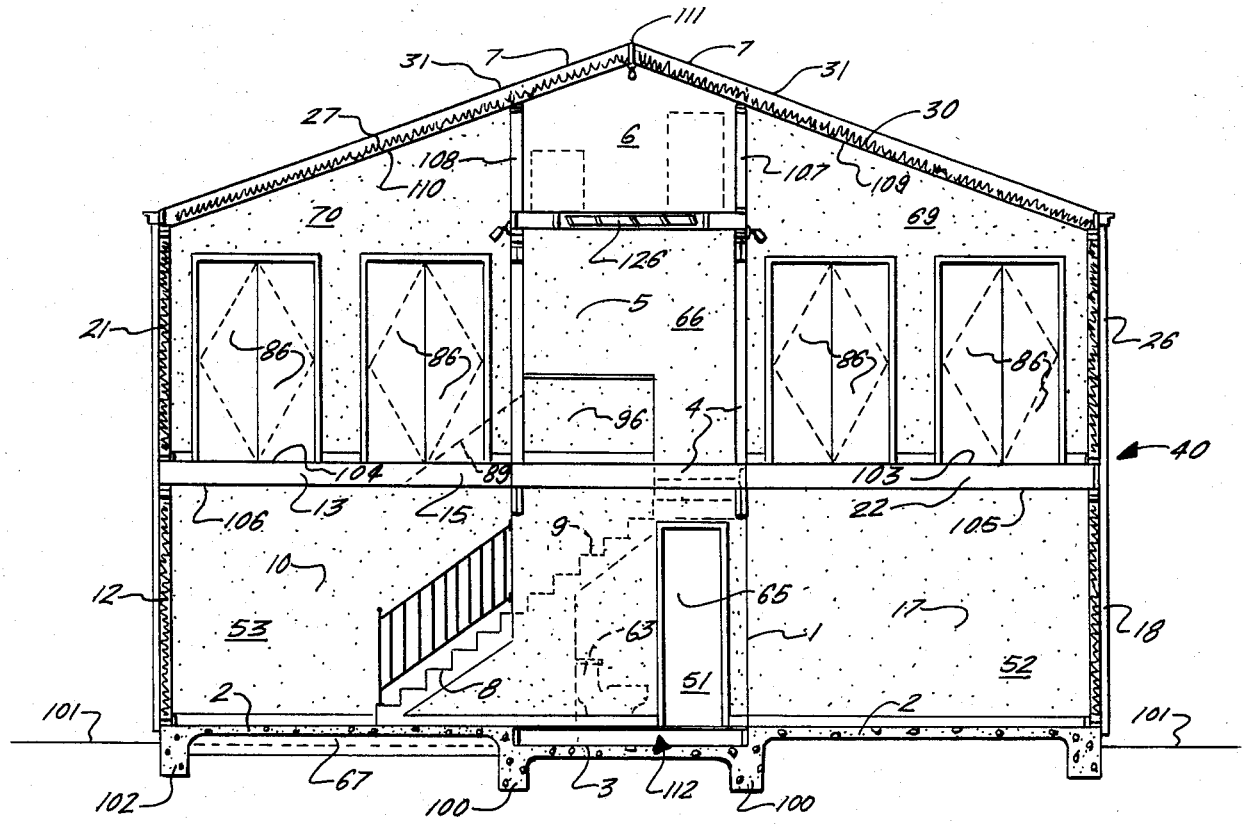
FIG. 12 is a diagrammatic, cross-sectional view of the structure shown in FIGS. 1–11.

Referring now to FIG. 12, the subject structure 40 is shown in diagrammatic, cross-sectional view illustrating the monolithic concrete slab 2 having central grade beams 100 extending below finished grade 101 structurally and supporting lower core module 1, middle core module 4, and upper core module 6, said modules forming a vertically stacked central core. Perimeter grade beams 102 below first floor panelized exterior wall elements 12 and 18, and second floor panelized exterior wall elements 21 and 26 structurally support said wall elements. The subject exterior wall elements 12 and 18 provide load bearing support for panelized floor elements 13 and 22 which span between said exterior wall elements 12, 18 and are depicted in FIG. 12 as interlocking with lower core module 1 at middle core module 4. When erected, the upper side of said panelized floor elements 13 and 22 establish part of master bedroom floor 103 and bedroom floor 104; the bottom side of said panelized elements form the living area ceiling 105 and den/dining area ceiling 106.

FIG. 12 further illustrates the placement of panelized roof element 30 which is installed at an angle extending downwardly and outwardly from upper core module 6, roof element 30 thereby structurally bearing on front attic wall 107 and second floor panelized exterior wall element 26. Roof element 30 forms a vaulted ceiling 109 above master bedroom 69. In similar fashion, panelized roof element 27 structurally bears upon rear attic wall 108 of upper core module 6, from which the subject roof element 27 spans downwardly and outwardly, ultimately bearing upon the top edge of second floor panelized top edge of second floor panelized exterior wall element 21 thus forming a vaulted ceiling 110 above bedroom 70.

FIG. 12 aso depicts the establishment of uniform roof planes created by the interface of panelized roof elements 27 and 30 with central roof 7 of upper core module 6. Similar angles of pitch of said roof elements 27, 30, and central roof 7 allow exterior roofing material 31 to be applied to two single plane surfaces intersecting at roof ridge 111 of upper core module 6.

Utilities servicing the subject structure are fed through a preformed trough depression 67 in the monolitic concrete slab 2, shown in FIG. 12 as originating below panelized exterior wall element 12 and extending across the floor of the den/dining area 53, continuing below stair component 8, until it intersects and connects within lower module base pallet 112. Said utility connections are more fully described in FIGS. 16, 17, 22, 23, 28, 29, 34, 35, and 37.

Figure 13:
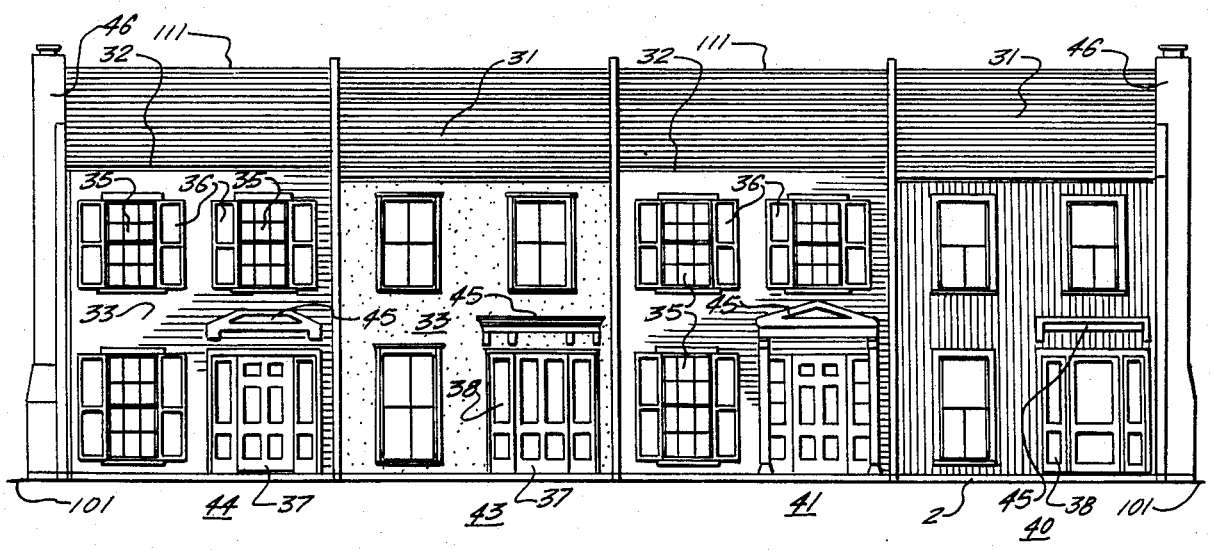
FIG. 13 is a front elevational view depicting a row of similar structures which includes the subject structures shown in FIGS. 10 and 11.

FIG. 13 depicts the frontal, elevational view of the subject structures 40 and 41, fully erected, with finished facades 33, wherein is illustrated a row of similar structures comprised of end buildings 40 and 44 interconnected with interior buildings 41 and 43. FIG. 13 further identifies location in elevation and alternative designs for wood or metal front entrance doors 37, double-hung windows 35, operable or fixed shutters 36, and side lites 38. Finished facades 33 may be embellished with entrance canopys 45. End buildings 40 and 44 have optional exterior fireplace/chimneys 46 attaching to finished side walls 39 and serving the living area 52 (as shown) or den/dining area 53.

Figure 14:
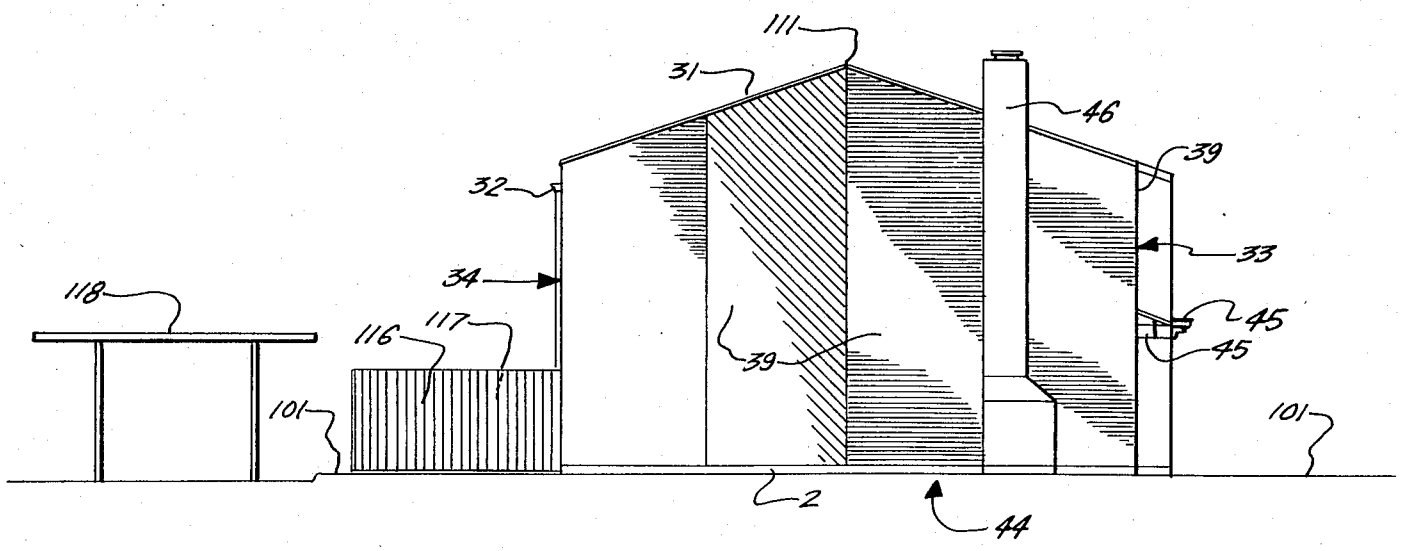
FIG. 14 is an end elevational view of one end of the subject structure.

FIG. 14 shows the end, elevational view of building 44, having a finished side wall 39 featuring an appended fireplace/chimney 46. Intersecting and abutting the finished rear elevation 34 at finished grade 101 is a fence 116 which encloses rear yard 117 connecting den/dining area 53 with optional carport 118.

Figure 15:
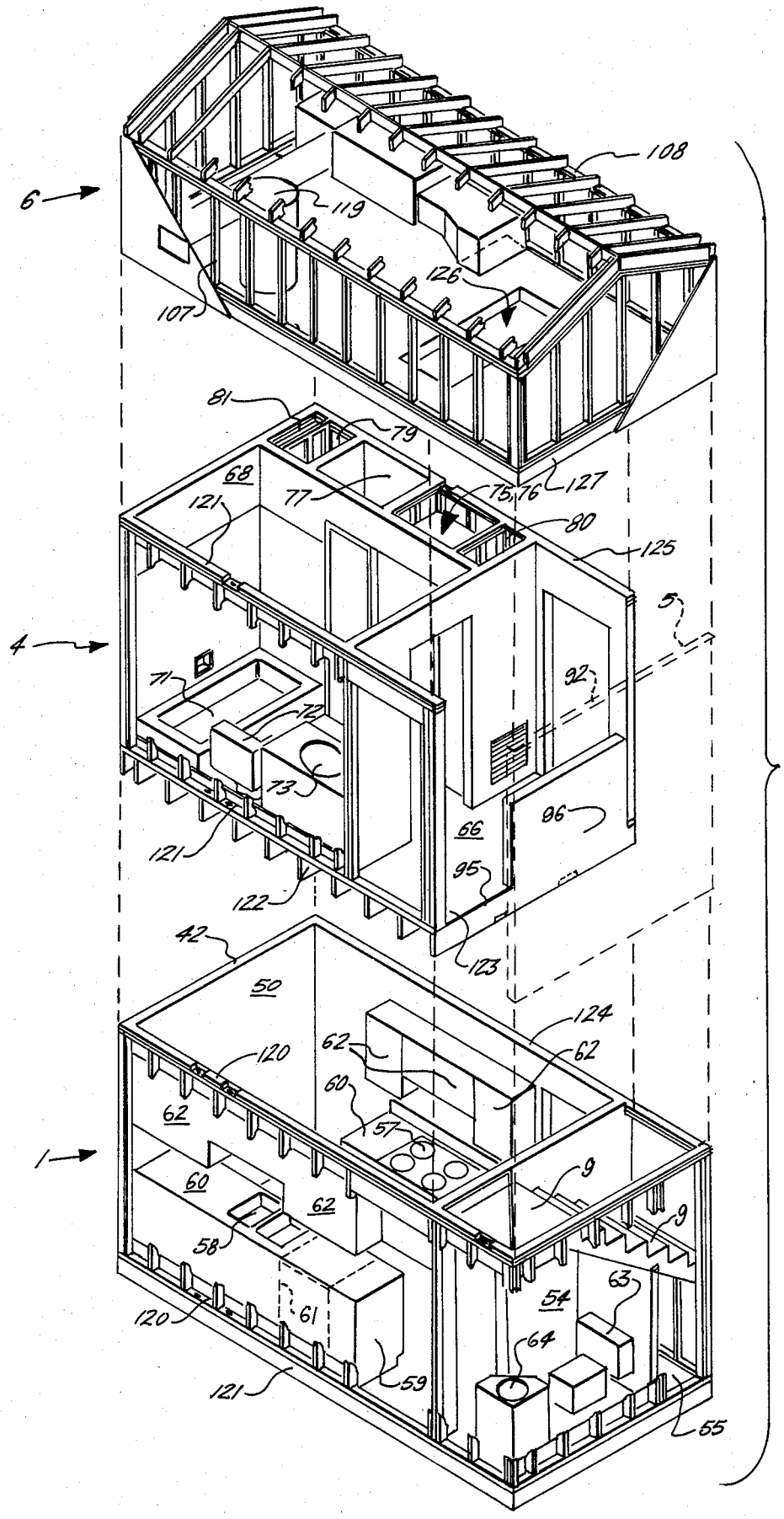
FIG. 15 is an isometric view of the central modular core of the structure shown in FIGS. 1–12 three dimensionally illustrating vertical stacking configuration and relative proximity of modules, fixtures comprising said core.

Having described the design and form of the subject buildings 40, 41, 43, and 44 in FIGS. 1–14, reference is now made to FIG. 15 which shows an isometric view of the interrelationship of the vertically stacked lower core module 1, middle core module 4, and upper core module 6. FIG. 15 illustrates three dimensionally the relative proximity of modules and fixtures comprising said core. To facilitate maximum manufactured prefabrication potential of the subject structure, all fixtures and appliances requiring plumbing have been located within said lower, middle, and upper core modules 1, 4, and 6. As shown in FIG. 15, fixtures and appliances requiring plumbing have been further grouped within said modules so as to be aligned vertically and be placed side-by-side horizontally, thus minimizing plumbing complexity. Said fixtures located side-by-side in lower core modules 1 are the double-pan sink 58 and dishwasher 61 which are shown installed in base cabinets 59 attached to lower core wet wall 120. Aligned vertically above said fixtures in middle core module 4 are the toilet 72, lavatory 73, and bathtub/shower 71, which are attached to middle core wet wall 121. Aligned vertically above said lower and middle core fixtures and located in upper core module 6 is hot water heater 119 which downfeeds service through front attic wall 107 into middle core wet wall 121 and lower core wet wall 120. In addition to facilitating plumbing, the subject walls 120, 121, and 107 vertically align, thereby forming load-bearing structural walls which extend laterally across the width of the building.

FIG. 15 further illustrates a plurality of transverse floor joists 122 in floored base pallet 123 of middle core module 4 which bear structurally upon lower core wet wall 120 and span across the ceiling of kitchen 50 bearing there upon the top of lower core rear wall 124, thus supporting said module 4. The structural support system provided by the vertical alignment of load-bearing lower and middle core wet walls 120 and 121 interacting with a similar alignment of load-bearing lower and middle core rear walls 124 and 125 obtained by stacking core modules 1 and 4, provides the framing required to receive and carry the load of upper core module 6 when said module is set in place atop modules 1 and 4.

Interior circulation between levels of the modular core necessitated by the variations in vertical elevation from lower core module 1 to middle core module 4, to upper core module 6 are respectively facilitated by means of staircase 9 and pull-down staircase/ladder 126 located in upper module base pallet 127.

Figures 16, 17, 18:
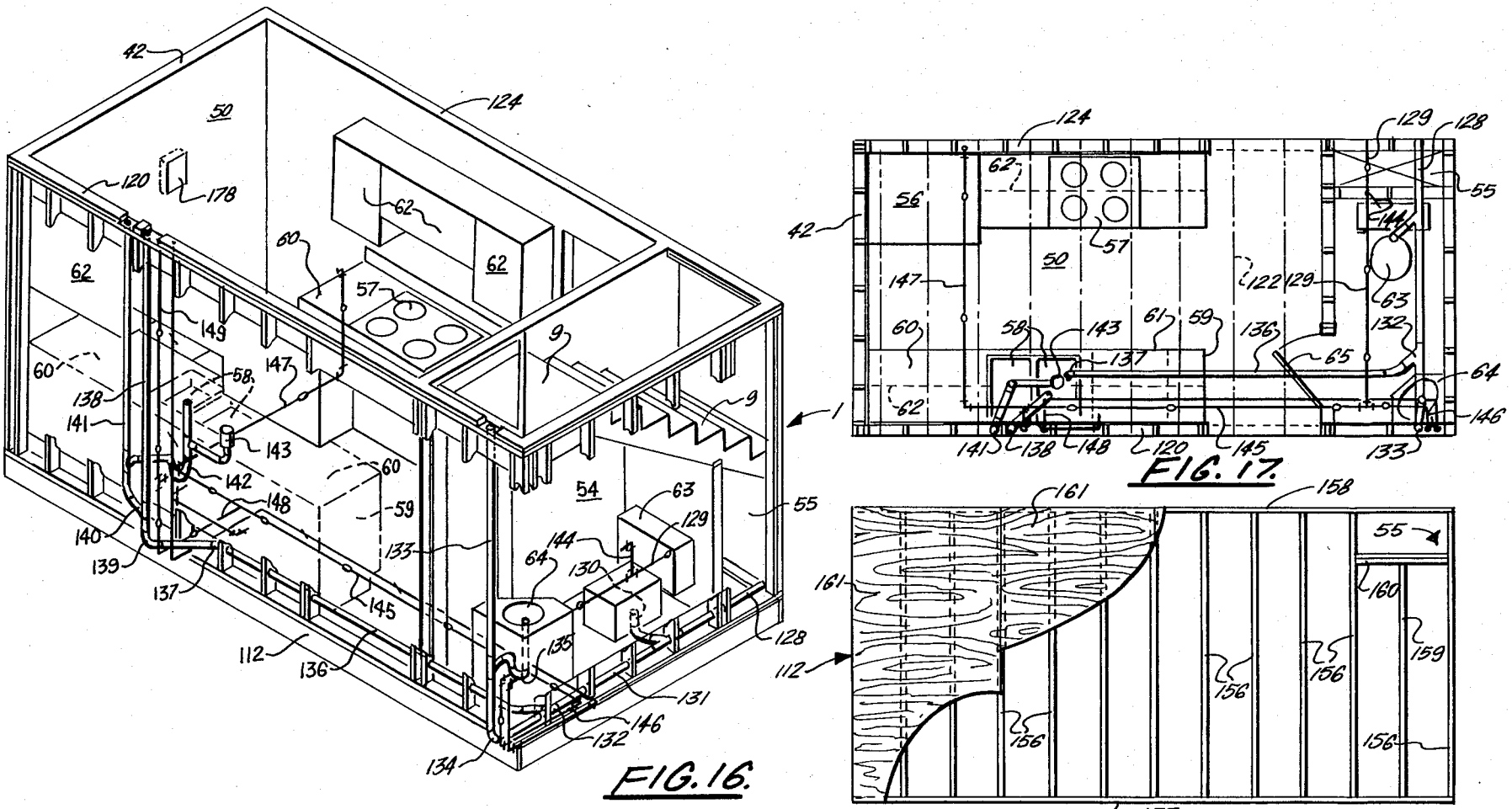
FIG. 16 is an isometric view of lower core module 1 which illustrated the water supply, sewage and drainage systems through incorporated riser diagrams.
FIG. 17 is a plan view of the plumbing system shown in FIG. 16.
FIG. 18 is a plan view of the lower module base pallet.

FIG. 16 is an isometric view of lower core module 1 which incorporates the plumbing system illustrated by a riser diagram in FIG. 16 depicting the sewage and drainage system. Said plumbing system for module 1 originates in service chase 55 wherein both main building drain 128 and cold water supply line 129 commence. Describing first the sewerage and drainage system, building drain 128 continues from service chase 55 under the floor of powder room 54 at which point it passes below toilet 63 and is connected thereto by drain 130. A header 131 continues horizontally below powder room 54 extending to branch fitting 132 at which point said system continues toward lavatory 64 and diverges in the direction of double-pan sink 58 in kitchen 50. Said system serving lavatory 64 intersects vertical vent and collection pipe 133 at elbow 134 and turns upwardly at a right angle into lower core wet wall 120. Drain 135 for lavatory 64 connects to vertical vent and collection pipe 133 which extends to the top of said wall 120, at which point it intersects and connects with middle core module 4. Referring now to that portion of the system diverging from branch fitting 132 in the direction of double pan sink 58, main horizontal pipe 136 proceeds below kitchen 50 to a point beneath sink 58 from which it turns at an angle, by means of elbow 137, toward lower core wet wall 120. Upon intersecting the plane of wall 120, pipe 136 departs lower module base pallet 112, turning upwardly and connecting to vertical main drain and vent pipe 138, at elbow 139, said collection pipe 138 extending the full height of wet wall 120 to the top of lower core module 1. Said vertical main drain and vent pipe 138 contains a branch fitting 140 connecting to secondary drain/vent pipe 141, which similarly extends the full height of wet wall 120 to the top of lower core module 1. Branching from secondary drain/vent pipe 141 is drain 142 for double-pan sink 58 and disposal 143. Disposal 143 receives discharge from drain 142 of dishwasher 61.

FIG. 16 further illustrates, in isometric diagram, cold water supply lines 129 which originate in lower core module 1 in service chase 55 immediately adjacent to main building drain 128. Cold water supply line 129 extends from service chase 55 through lower module base pallet 112 below powder room 54 to a point beneath toilet 63, whereat a vertical branch 144 of cold water supply line 129 enters powder room 54 and connects to toilet 63, line 129 continuing below powder room 54 in the general direction of lavatory 64 to a point at which line 129 intersects and merges into first floor horizontal water line 145 running at a right angle thereto. Horizontal water line 145 runs parallel and adjacent to main horizontal pipe 136 and extends through lower module base pallet 112 to points below lavatory 64 and double-pan sink 58. Referring first to the point below lavatory 64, horizontal water line 145 branches at a right angle and thence cold water pipe 146 proceeds to the front margin of lower module base pallet 112 below lower core wet wall 120, whereat cold water pipe 146 turns upwardly joining vanity cold water line 147 in wet wall 120 which extends vertically upwardly, ultimately connecting lavatory 64. Returning to the point in horizontal first floor water line 145 below double-pan sink 58, said water line continues onwardly and simultaneously branches at a right angle toward the front margin of lower module base pallet 112 below lower core wet wall 120, subsequently turning at a right angle toward the rear margin of base pallet 112 to refrigerator service pipe 147, ultimately connecting refrigerator 56. Cold water branch 148, extending from water line 145 below sink 58 to below wet wall 120, turns upwardly into said wall and continues to the top of lower core module 1 forming vertical cold water supply line 149, whereat water supply line 149 branches out from lower core wet wall 120 serving double-pan sink 58.

FIG. 17 represents a plan view of the plumbing system described in FIG. 16 and shown therein in isometric view.

Figure 19:
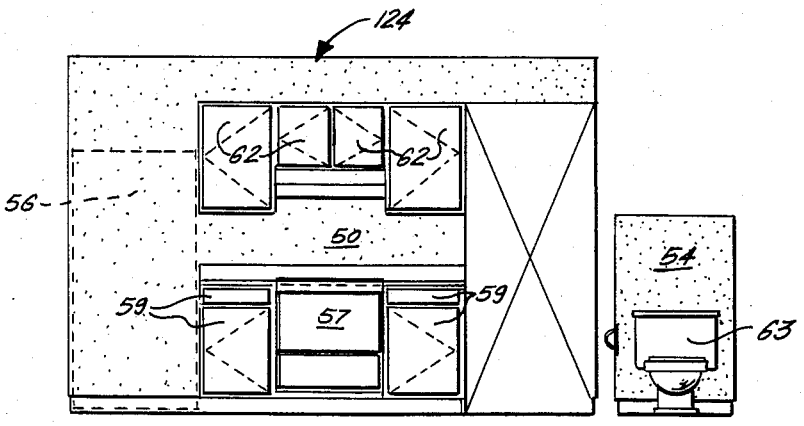
FIG. 19 is a sectional, interior, elevational view of the first floor kitchen and powder room showing appurtenances to the lower core rear wall.

FIG. 18 depicts the framing system of lower module base pallet 112 through which the horizontal elements of said plumbing system, commencing at service chase 55, extend. Lower module base pallet 112 is composed of a plurality of wood or metal lower module floor joists 156 which span from front base header 157 below lower core wet wall 120 to rear base header 158 below lower core rear wall 124. Said framing system is employed throughout lower module base pallet 112 with the exception of chase joist 159 below powder room 54 which spans from front base header 157 to double chase header 160, thereby creating the lower section of service chase 55. The frame for lower module base pallet 112, composed of floor joists 156, headers 157, 158, chase joist 159 and double chase header 160, is covered on its top surface with plywood decking 161 of preferably standard 4′×8′ manufactured sizes, four sheets of said plywood decking 161 being placed side-by-side, parallel to floor joists 156 and securely fastened thereto. FIG. 19 illustrates in elevational view the fixtures and appliances in central kitchen 50 which attach to lower core rear wall 124 and the placement of toilet 63 in powder room 54.

Figure 20:
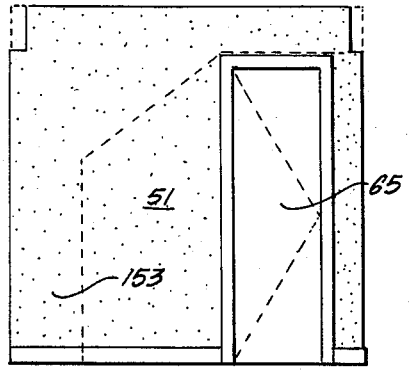
FIG. 20 is a sectional, interior, elevational view of the first floor hallway.

FIG. 20 shows in sectional, elevational view finished wall 153 of internal circulation corridor 51 and the entrance door 65 to powder room 54.

Figure 21:
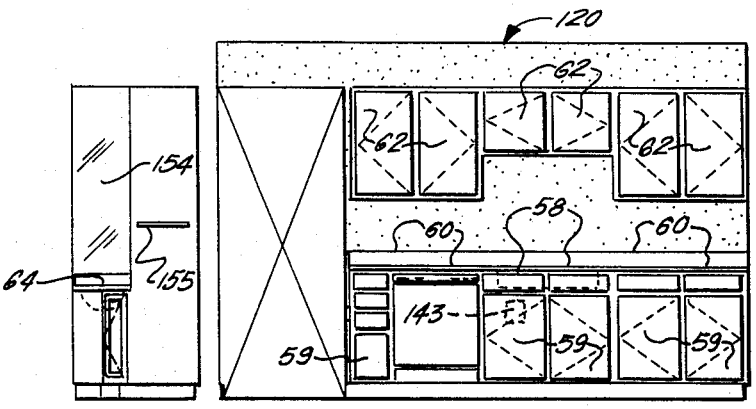
FIG. 21 is a sectional, interior, elevational view of the first floor kitchen and powder room showing appurtenances to the lower core wet wall.

FIG. 21 illustrates in elevational view the fixtures and appliances in central kitchen 50 which attach to lower core wet wall 120, and the placement of lavatory 64 in powder room 54, same having a fixed mirror 154 above and adjacent towel bar 155. As detailed in FIG. 16, the fixtures shown in FIG. 21 serviced by wet wall 120 are the lavatory 64, double-pan sink 58 with disposer 143, and dishwasher 61.

Figure 22:
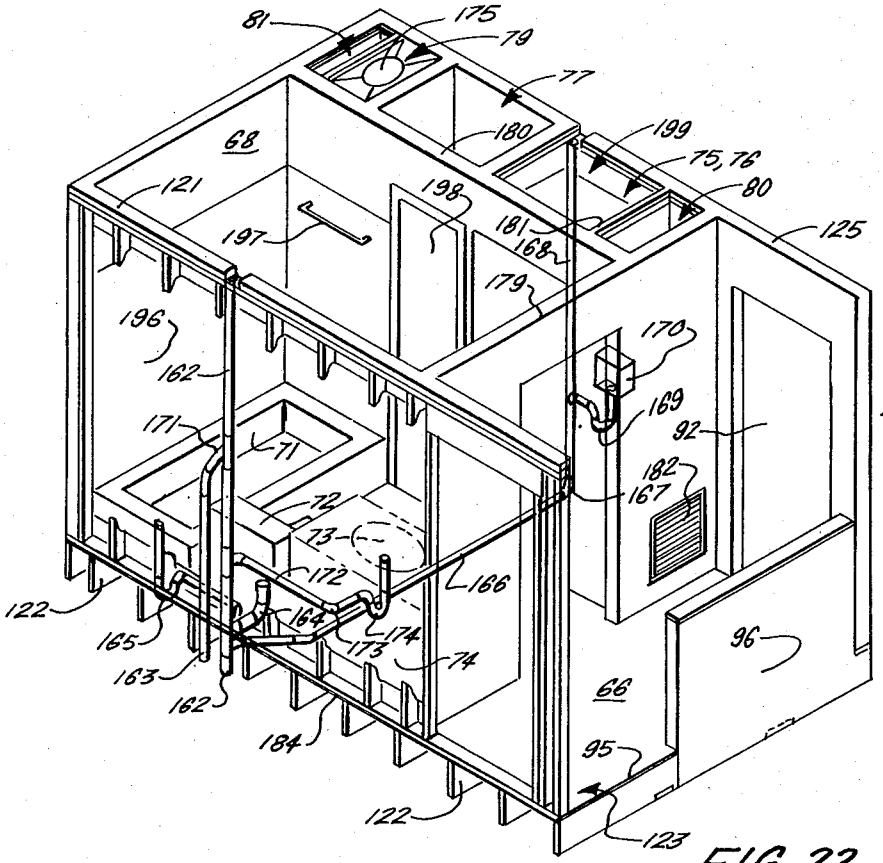
FIG. 22 is an isometric, cross-sectional view of the middle core module wherein the plumbing system is therein shown deployed.

FIG. 22 is an isometric view of middle core module 4 which incorporates the plumbing system illustrated by a riser diagram in FIG. 22 depicting the sewage and drainage system. Said plumbing system for middle core module 4 originates in floored, middle core base pallet 123 below toilet 72 whereat base pallet 123 intersects lower core wet wall 120. At the point of said intersection, vertical main drain and vent pipe 138 connects with middle core vertical main drain and vent pipe 162 and secondary drain/vent pipe 141 from lower core wet wall 120 connects with middle core secondary drain pipe 163, said connections being more fully described in FIG. 37. FIG. 22 shows the extension of middle core vertical main drain and vent pipe 162 from the bottom of middle core base pallet 123, through middle core wet wall 121, to the top of wet wall 121 at which point pipe 162 intersects upper core module 6. Middle core secondary vent pipe 163 extends upwardly from middle core base pallet 123 into middle core wet wall 121 and rises to an elevation exceeding the upper margin of lavatory 73, at which point secondary vent pipe 163 merges into middle core vertical main drain and vent pipe 162 by means of fitting 171. Branching out from middle core vertical main drain and vent pipe 162 within floored, middle core base pallet 123 are toilet drain 164 serving toilet 72, bathtub/shower drain 165 serving bathtub/shower 71, and horizontal washing machine drain pipe 166. Horizontal washing machine drain pipe 166 extends from pipe 162 below the floor of bathroom 68, across middle core module 4, parallel to transverse floor joists 122 in base pallet 123 to a point where it intersects the rear margin of base pallet 123, below middle core rear wall 125, at which point horizontal washing machine drain pipe 166 connects with elbow 167 and turns at a right angle extending upwardly therefrom and forming vertical washing machine drain and vent pipe 168 which continues through middle core rear wall 125 to the top of wall 125. Branching from vertical washing machine drain and vent pipe 168 is washing machine drain 169 which receives discharge from washing machine 76 in recessed collection pan 170.

Returning to the point in FIG. 22 whereat horizontal washing machine drain pipe 166 intersects middle core main drain and vent pipe 162, below toilet 72, middle core main drain and vent pipe 162 continues upwardly into middle core wet wall 121 and branches toward lavatory 73, thereby forming horizontal lavatory drain pipe 172. Horizontal lavatory drain pipe 172 continues through the interior of middle core wet wall 121 to a point behind lavatory 73 where it turns at a right angle, by means of lavatory elbow 173, into vanity base cabinet 74, ultimately connecting lavatory drain 174.

Figure 23:
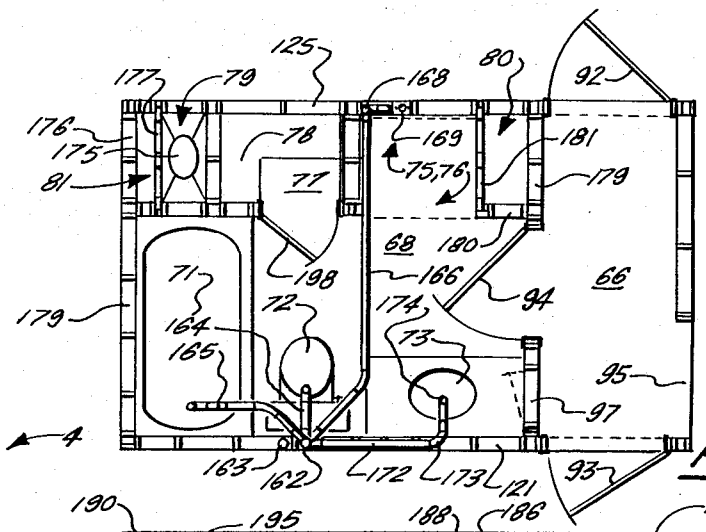
FIG. 23 is a plan view of the middle core module and plumbing system shown in FIG. 22.

Referring now to FIG. 23, the plumbing system described in FIG. 22 is illustrated in plan view, depicting the relative proximity of fixtures served by said system. FIG. 23 shows branches from middle core vertical main drain and vent pipe 162 serving toilet 72 by means of toilet drain 164, bathtub/shower 71 by means of bathtub/shower drain 165, washing machine 76 by means of horizontal washing machine drain pipe 166, and lavatory 73 by means of horizontal lavatory drain pipe 172.

FIG. 23 shows a series of vertical chase spaces consisting of electrical wiring chase 81, return-air chase 80, and air-conditioning supply chase 79, which are utilized to interconnect services between lower core module 1, middle core module 4, and upper core module 6 comprising the stacked modular core of the subject structure. As a result of central placement within said stacked modular core, middle core module 4 primarily interacts with lower core module 1 and upper core module 6 in the reception and transmission of said services. Thus, electrical wiring chase 81, return-air chase 80, and air-conditioning supply chase 79 respectively extend from the bottom of transverse floor joists 122, lower module base pallet 112, to the uppermost extremity of middle core module 4.

As illustrated in FIG. 23, electrical wiring chase 81 in the rear corner of middle core module 4 is bordered by the walls of bathtub/shower 71, double central second floor party wall 176, middle core rear wall 125, and separated by chase partition 177 from air-conditioning supply chase 79. Electrical wiring chase 81 provides a raceway for electrical service to equipment in upper core module 6 which is connected to factory installed wiring coiled at the top of said electrical wiring chase 81. Said wiring servicing equipment in upper core module 6 is similarly coiled at the bottom of electrical wiring chase 81 for ease of connection to electrical distribution panel 178 located immediately below in lower core module 1, central kitchen 50, and double central first floor party wall 42 shown in FIG. 16. Electrical wiring serving circuits (not shown) connected to middle core module 4 are also coiled at the bottom of electrical wiring chase 81 for subsequent connection to electrical distribution panel 178 following erection of said structure.

FIG. 23 shows return-air chase 80 in the corner of bathroom 68 bordered by middle core rear wall 125, second floor hallway wall 179, bathroom wall 180 and washer/dryer partition wall 181. Return-air chase 80 forms a vertical shaft within middle core module 4, intersecting and connecting to upper core module 6 at its upper end and collecting return-air from the kitchen 50 at its lower end. Return-air chase 80 connects to return-air grill 182 mounted in second floor hallway wall 179, as can be seen in FIG. 22. In similar fashion, return-air may be drawn from bedroom 70 by installation of a grill penetrating middle core rear wall 125 connecting bedroom 70 with return-air chase 80.

Further illustrated in FIG. 23 is air-conditioning supply chase 79 being formed in the corner of middle core module 4 and bordered by the walls of bathtub/shower 71, linen closet 77, middle core rear wall 125, and chase partition 177 dividing air-conditioning supply chase 79 from electrical wiring chase 81. Air-conditioning supply chase 79 preferably extends the full vertical height of middle core module 4, extending upwardly from the bottom of transverse floor joists 122 in middle module base pallet 123 to the upper extremities of middle core module 4, at which point air-conditioning supply chase 79 intersects and connects with upper core module 6. Vertical air-conditioning supply duct 175 is mounted within air-conditioning supply chase 79 and similarly extends from the upper extremities of middle core module 4 into middle module base pallet 123, at which point vertical air-conditioning supply duct 175 branches horizontally.

Figure 24:
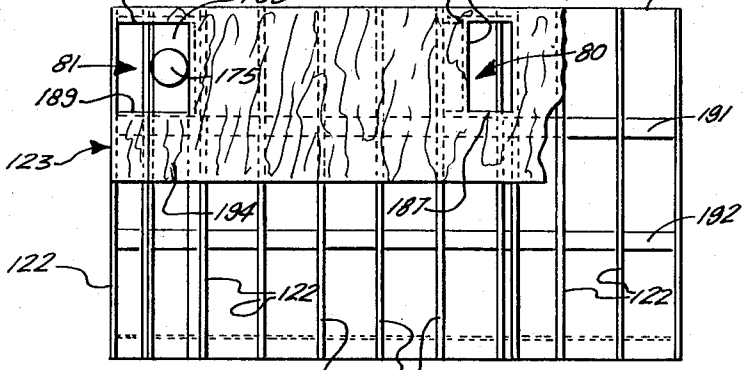
FIG. 24 is a plan view of the middle module base pallet.

FIG. 24 depicts the framing system of middle module base pallet 123 through which said horizontal elements, living area supply duct 194 and den/dining supply duct 195, branching from vertical air- conditioning supply duct 175, extend. Middle module base pallet 123 is comprised of a plurality of transverse floor joists 122 which span from middle module front margin 184 to middle module rear margin 185. Living area supply duct 194 is installed parallel to and runs horizontally between said transverse floor joists 122 of middle module base pallet 123, wherein living area supply duct 194 originates at the lower end of vertical air-conditioning supply duct 175 and extends outwardly to middle module front margin 184. Living area supply duct 194 is comprised of flexible air-conditioning duct material in sufficient quantity to be compressed and packed into middle module base pallet 123, between transverse floor joists 122, for subsequent extension and connection to corresponding materials in panelized floor element 23 supplying air-conditioning to living area 52. Den/dining supply duct 195 originates at the lower end of vertical air-conditioning supply duct 175 and extends outwardly to middle module rear margin 185. In similar fashion, den/dining supply duct 195, which is comprised of the same material as living area supply duct 194, is compressed in the cavity between transverse floor joists 122 in middle module base pallet 123 for subsequent extension and connection with corresponding materials in panelized floor element 14 supplying air-conditioning to den/dining area 53. The structural framing system for middle module base pallet 123 comprises a plurality of transverse floor joists 122 which are evenly-spaced and securely fastened to front base stringer 191 and rear base stringer 192, which are installed below and notched into transverse floor joists 122 and interacting with middle module plywood decking 193 applied above transverse floor joists 122 which are similarly fastened to provide a rigid middle module base pallet 123. Transverse floor joists 122 are allowed to penetrate return-air chase 80 and continue therethrough unaltered. Return-air blocking 186 is used between front return-air header 187 and rear return-air header 188 to enclose and separate return-air chase 80 from the interior of middle module base pallet 123. In a similar manner, transverse floor joists 122 pass between and divide air-conditioning supply chase 79 from electrical wiring chase 81. Front electrical chase blocking 189 and rear electrical chase blocking 190 are employed to enclose electrical wiring chase 81.

Figure 25:
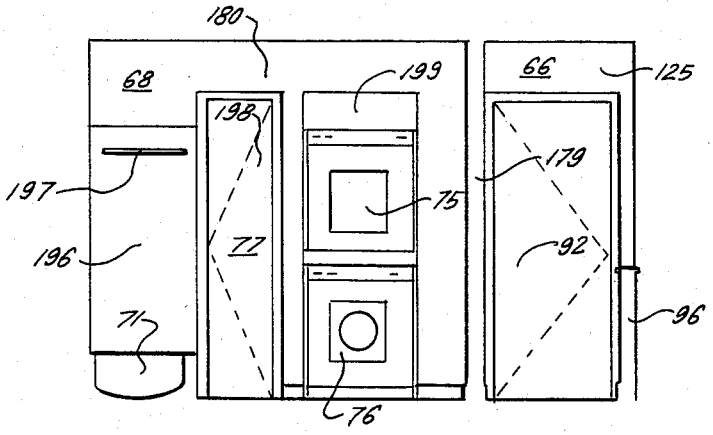
FIG. 25 is a sectional, interior, elevational view of the second floor bathroom and hallway showing fixtures, appliances and doors.

FIG. 25 illustrates in sectional, elevational view the fixtures and appliances in bathroom 68 which attach to or recess into bathroom wall 180 and middle core rear wall 125 as seen from second floor hallway 66. Bathtub/shower 71 is comprises a shower alcove 196 and bath towel bar 197, immediately adjacent to linen closet door 198. Vertically stacked washing machine 76 and electric clothes dryer 75 recess into laundry alcove 199 in bathroom wall 180. Bedroom passage door 92 to bedroom 70 is disposed in second floor hallway 66 between walled railing 96 and second floor hallway wall 179.

Figure 26:
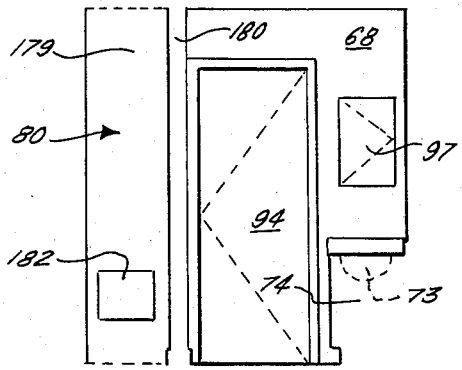
FIG. 26 is a sectional, interior, elevational view of the middle core module showing the return-air chase and second floor bathroom.

FIG. 26 shows in sectional, elevational view the interior of return-air chase 80 and depicts return-air grill 182 installed in second floor hallway wall 179. Return-air chase 80 is separated from bathroom 68 by bathroom wall 180. Bath- room passage door 94 provides access to bathroom 68 from second floor hallway 66. Immediately adjacent to bathroom passage door 94 is vanity base cabinet 74, shown in profile as containing lavatory 73. Directly above vanity base cabinet 74, a medicine cabinet 97 is recess-mounted in second floor hallway wall 179.

Figure 27:
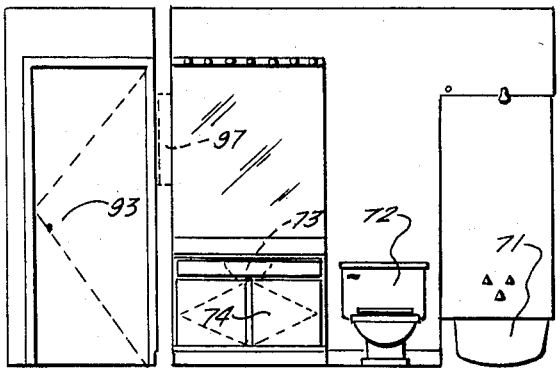
FIG. 27 is a sectional, interior, elevational view of the second floor hallway and bathroom.

FIG. 27 depicts the appurtenances in bathroom 68 which attach to or abut middle core wet wall 121. The bathtub/shower 71 is depicted in cross-section and features a shower alcove 196 through which hot and cold water valves 201 protrude from middle core wet wall 121. Immediately below water valves 201 is tub spout 202 and directly above, near the upper margin of shower alcove 196, is shower nozzle 203. Located to the left of bathtub/shower 71 is toilet 72 which is immediately adjacent to vanity base cabinet 74 containing lavatory 73. A plate glass mirror 204 is mounted above lavatory 73 on middle core wet wall 121. Lighting fixture 205 is mounted on middle core wet wall 121 above mirror 204. Medicine cabinet 97, immediatedly to the left of lavatory 73, is recessed into second floor hallway wall 179. Also shown in FIG. 27 is master bedroom passage door 93 in second floor hallway 66.

Figure 28:
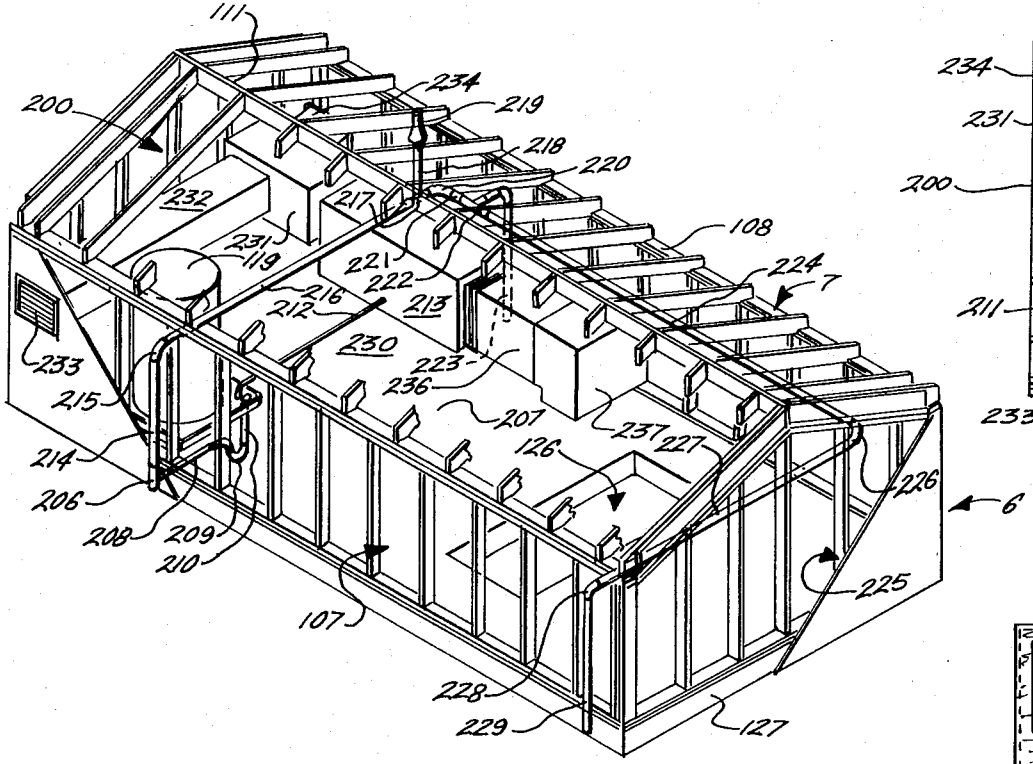
FIG. 28 is an isometric view of the upper core module which illustrates the water supply, vent and drainage system through incorporated riser diagrams.

FIG. 28 is an isometric view of upper core module 6 which incorporates the plumbing system illustrated by a riser diagram therein depicting the ventilation and drainage system. The plumbing system for upper core module 6 originates in upper module base pallet 127 adjacent to hot water heater 119 disposed directly thereabove and connected to middle core vertical main drain and vent pipe 162, said connection being similar to that illustrated in FIG. 37. The upper core vertical main drain and vent pipe 206 branches below attic floor 207 and connects with horizonal overflow pan drain pipe 208 which continues thereafter and connects with overflow pan trap 209 and vertical overflow pan drain pipe 210 which penetrates the bottom of overflow pan 211. Hot water heater 119 is mounted inside overflow pan 211 thereby providing drainage for released overflow or leakage. The condensate drain pipe 212 from central air- conditioning system 213 extends horizontally above attic floor 207 and discharges into overflow pan 211, thereby providing drainage for moisture withdrawn from the air. Upper core vertical main drain and vent pipe 206 extends vertically upwardly from upper module base pallet 127 into front attic wall 107 and connects to upper core vertical main vent pipe 214 which continues upwardly and turns, by means of elbow 215, before reaching the upper margin of front attic wall 107, thereafter extending at an incline beneath central roof 7 and forming front inclined vent pipe 216. At a point adjacent to roof ridge 111, below central roof 7, the uppermost extremity of front inclined vent pipe 216 connects with three-directional fitting 217 from which system vent pipe 218 extends vertically and penetrates central roof 7. Vent cap 219 covers system vent pipe 218 and prevents foreign matter from entering the plumbing system. At a point opposite the connection for front inclined vent pipe 216, elbow 220 turns at a right angle and thereby connects three-directional fitting 217 to upper core secondary vent pipe 221, thereafter joining three-directional branch fitting 222. Two vent systems, namely uper core washing machine vent pipe 223 and upper core horizonal vent pipe 224 merge at three-directional branch fitting 222. Upper core washing machine vent pipe 223, turns downwardly upon entering rear attic wall 108 and continues in a downward direction to the lower margin of upper module base pallet 127, at which point it connects with middle core module 4, vertical washing machine drain and vent pipe 168 in a fashion similar to that illustrated by FIG. 37. Upper core horizontal vent pipe 224, continues below central roof 7 parallel to roof ridge 111 and turns before double central attic party wall 225 at elbow 226, thereupon connecting with inclined vanity vent pipe 227; continuing toward and entering front attic wall 107, inclined vanity vent pipe 227 turns downward at elbow 228 and connects with upper core vertical vanity vent pipe 229 which continues in a downward direction to the lower margin of upper module base pallet 127 at which point it connects through middle core module 4 with vertical vent and collection pipe 133 in lower core module 1 in a fashion similar to that illustrated in FIG. 37.

The central air-conditioning system 213 is shown in FIG. 28 as located in attic 230 of upper core module 6. Pull-down staircase/ladder 126 provides access for servicing the central air-conditioning system 213 which is mounted on attic floor 207 across from hot water heater 119, against rear attic wall 108. Supply air for the building is directed from the central air-conditioning system 213 into supply-air plenum 231 from which master bedroom supply duct 232 branches in the direction of front attic wall 107, continuing to and penetrating front attic wall 107 at which point master bedroom supply register 233 is mounted for service to master bedroom 69. Emerging from the opposite side of supply-air plenum 231 is bedroom supply duct 234 which penetrates rear attic wall 108 and serves bedroom 70 through bedroom supply register 235. The supply-air plenum 231 is located directly above air-conditioning supply chase 79, as shown in FIG. 30, which connects, at the lower margin of upper module base pallet 127, with vertical air-conditioning supply duct 175 in middle core module 4 depicted in FIG. 22.

Return-air for central air-conditioning system 213 is collected through return-air plenum 236 which extends outwardly in the direction of pull-down staircase/ladder 126 to a point above return-air chase 80 (see FIG. 30) where return-air duct 237 connects, at the lower margin of upper module base pallet 127, with middle core module 4 as is depicted in FIG. 22.

Figure 29:
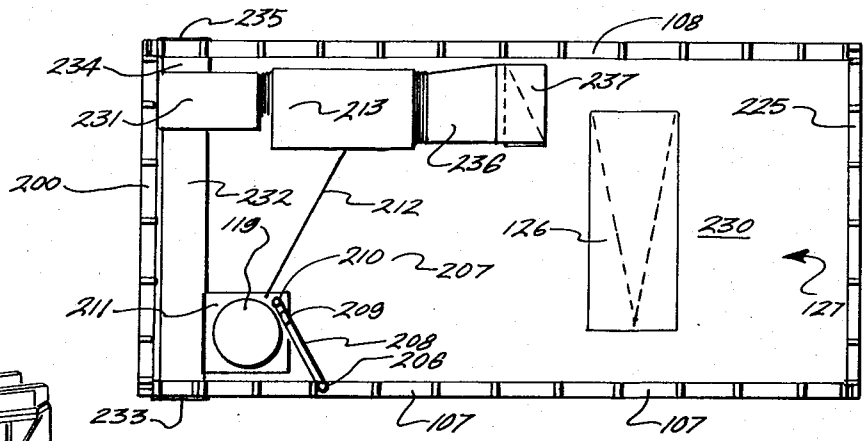
FIG. 29 is a plan view of the upper core module and plumbing system shown in FIG. 28.

Referring now to FIG. 29, the plumbing system described in FIG. 28 is illustrated in plan view depicting the relative proximity of fixtures served by said system. FIG. 29 shows the drainage system for overflow pan 211 which connects to upper core vertical main drain and vent pipe 206. Hot water heater 119 is mounted in overflow pan 211 in order to allow proper drainage for leakage or overflow. Also draining into overflow pan 211 is condensate drain pipe 212 which discharges condensation removed from the air by central-air conditioning system 213. FIG. 30 correlates in plan view the relative proximity of openings through upper module base pallet 127 with the central air-conditioning system 213, as is diagramatically illustrated in FIG. 29. Air-conditioning supply chase 79 (as can be seen in FIG. 30) is located directly below supply-air plenum 231 (as can be seen in FIG. 29) and in similar fashion return-air chase 80 (as can be seen in FIG. 30) is located directly below return-air duct 237 (as can be seen in FIG. 29). This configuration allows the systems to be united during the erection process.

Figure 30:
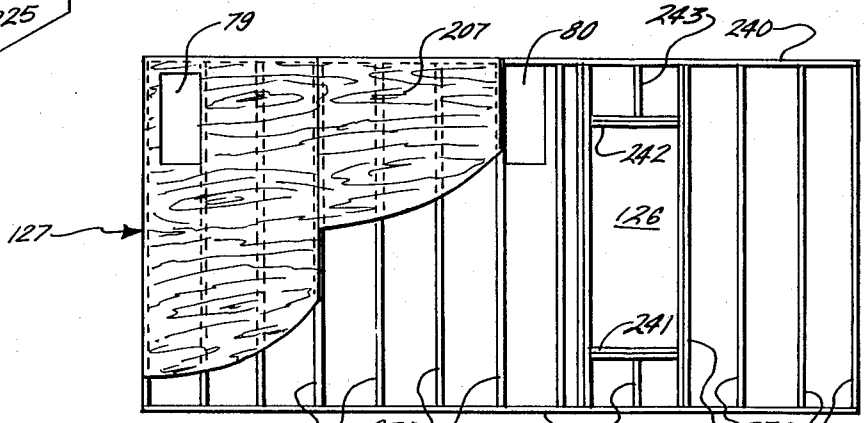
FIG. 30 is a plan view of the middle module base pallet.

Further illustrated in FIG. 30 is the framing plan for upper module base pallet 127 which is comprised of a plurality of upper module floor joists 238 which span from upper module front base header 239 to upper module rear base header 240. An opening in upper module base pallet 127 to accommodate pulldown staircase/ladder 126 is formed by front double header 241 and rear double header 242 which span laterally, perpendicularly to upper module floor joists 238, creating a framed enclosure. The floor framing pattern is completed by upper module stair joists 243 which span from front double header 241 to upper module front base header 239 and from rear double header 242 to upper module rear base header 240.

Figure 31:
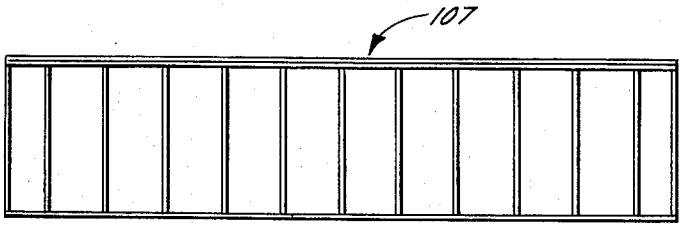
FIG. 31 is sectional, interior, elevational view of the front attic wall.

FIG. 31 illustrates in sectional, elevational view the fixtures and mechanical systems in attic 230 which interact with front attic wall 107.

Figure 32:
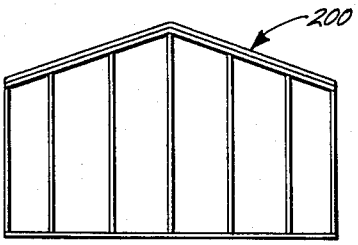
FIG. 32 is a sectional, interior, elevational view of the double central attic party wall.

FIG. 32 shows in sectional elevation view double central attic party wall 200.

Figure 33:
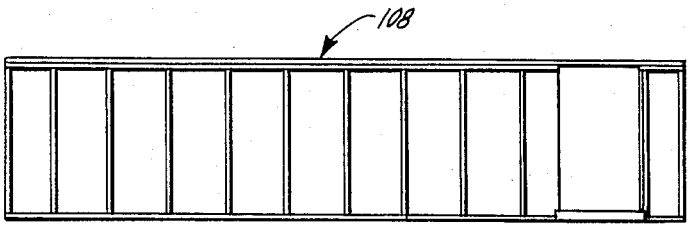
FIG. 33 is a sectional, interior, elevational view of the rear attic wall.

FIG. 33 depicts in sectional, elevational view the rear attic wall 107 of upper core module 6 and the central air-conditioning system 213 in attic 230.

Figure 34:
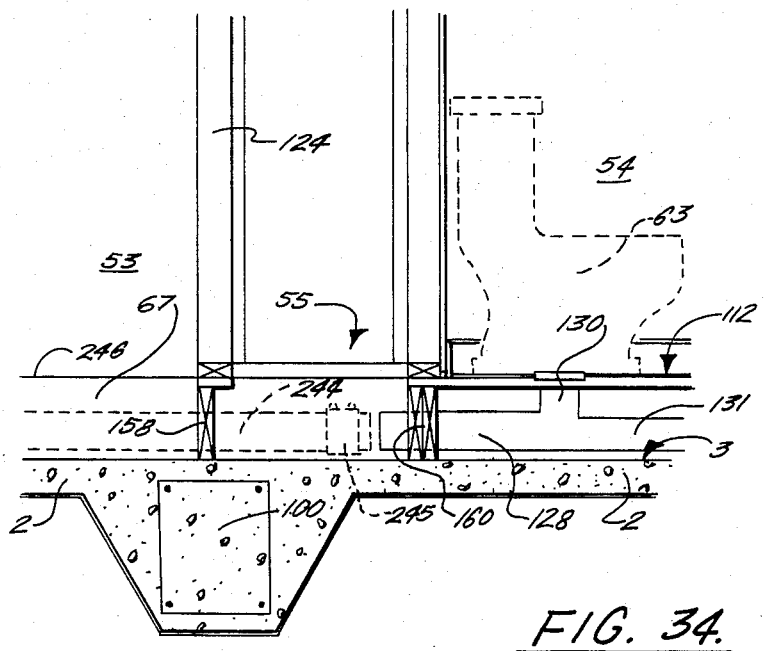
FIG. 34 is a sectional view of the requisite plumbing connections in the lower core module service chase.

Final plumbing connections to lower core module 1 are illustrated in sectional view in FIG. 34 as occuring within lower module base pallet 112 at the bottom of service chase 55. After placement of the prefabricated lower core module 1 in preformed slab depression 3 of monolithic concrete slab 2, and after the subsequent erection procedures depicted in FIGS. 1-9, the prefabricated internal plumbing system commencing at main building drain 128 is connected to exterior site work and municipal sewerage and drainage facilities (not shown) by intersection of recessed main drain and collection pipe 244 which extends from service chase 55 through preformed trough depression 67 in den/dining area 53. Recessed main drain and collection pipe 244 is connected to main building drain 128 by means of no-hub connection 245. Preformed trough depression 67 accommodates the entrance of additional services to the building and is subsequently filled with concrete preferably of finished interior slab grade 246, thus creating a uniform floor surface in den/dining area 53. Also depicted in FIG. 34 are toilet 63 in powder room 54 which connects to main building drain 128 by means of drain 130.

Figure 35:
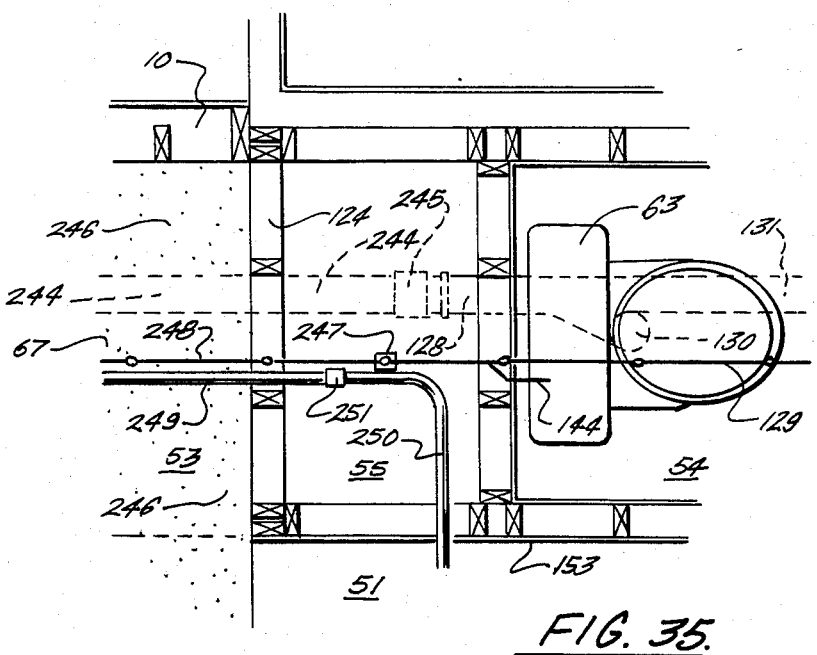
FIG. 35 is a plan view of the plumbing connections shown in FIG. 34.

The plumbing connections shown in FIG. 34 are depicted in plan view in FIG. 35. Recessed main drain and collection pipe 244 is shown entering service chase 55 throug preformed trough depression 67 and completing the plumbing system upon connection to main building drain 128 by means of no-hub connection 245. Cold water supply line 129 is installed as a prefabricated element of lower core module 1, commencing in service chase 55 and paralleling main building drain 128. Cold water supply line 129 is connected to cold water service pipe 248 by means of cold water service union 247 in service chase 55. Cold water service pipe 248 exits the rear of the structure through preformed trough depression running parallel and adjacent to recessed main drain and collection pipe 244. Also extending through dapped trough depression 67 between service chase 55 and the exterior of the structure is main electrical service conduit 249 which joins building service conduit 250, prefabricated into lower core module 1, by means of conduit connector 251. Building service conduit 250 extends below the plywood decking 161 of lower module base pallet 112 to a point below double central first floor party wall 42, at which point it turns upwardly ultimately connecting with electrical distribution panel 178 (as can be seen in FIG. 16). Main electrical service conduit 249, disposed in preformed trough depression 67, connections to an exterior main fuse 252 and electric meter 253 (as can be seen in FIG. 9) are completed by means of vertical exterior electrical conduit 254 extending from the end of main electrical service conduit 249, at the point whereat it penetrates the rear of the structure below panelized exterior wall element 12, upwardly in the direction of and connecting to main fuse 252, thereafter entering and connecting to electric meter 253.

Figure 36:
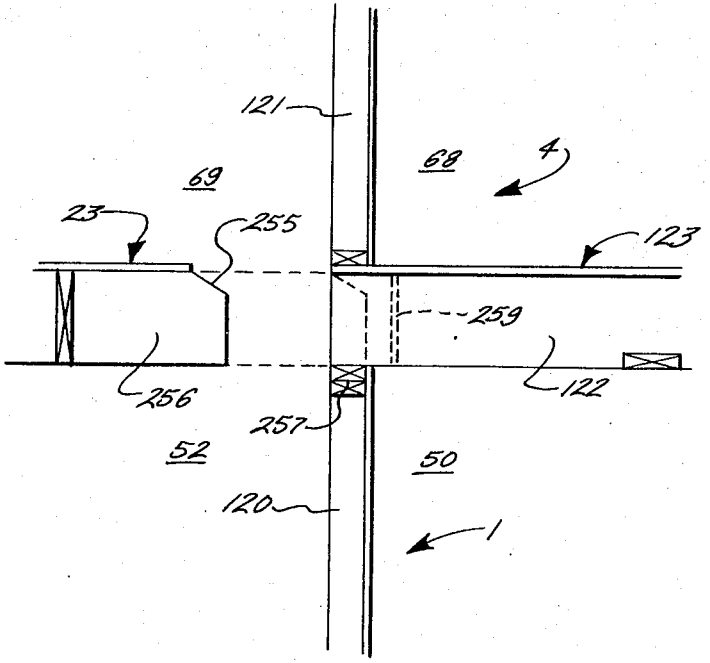
FIG. 36 is a diagrammatic, cross-sectional view of the interconnection of panelized floor elements between the stacked lower and middle core modules.

The method of connecting panelized floor element 23 between lower core module 1 and middle core module 4 is depicted in diagrammatic cross-section in FIG. 36. Interconnection is accomplished by inserting the beveled joist heads 255 of a plurality of floor joists 256, which are integral parts of panelized floor element 23, into the space between transverse floor joists 122 of middle module base pallet 123. The floor joists 256 of panelized floor element 23 bear structurally upon lower core wet wall 120 of lower core module 1 at double top plate 257. Once installed in final position, panelized floor element 23 is securely fastened in place. The method of connecting panelized floor element 23 is typical of the system employed to install panelized floor elements 13, 14 and 22.

Figure 37:
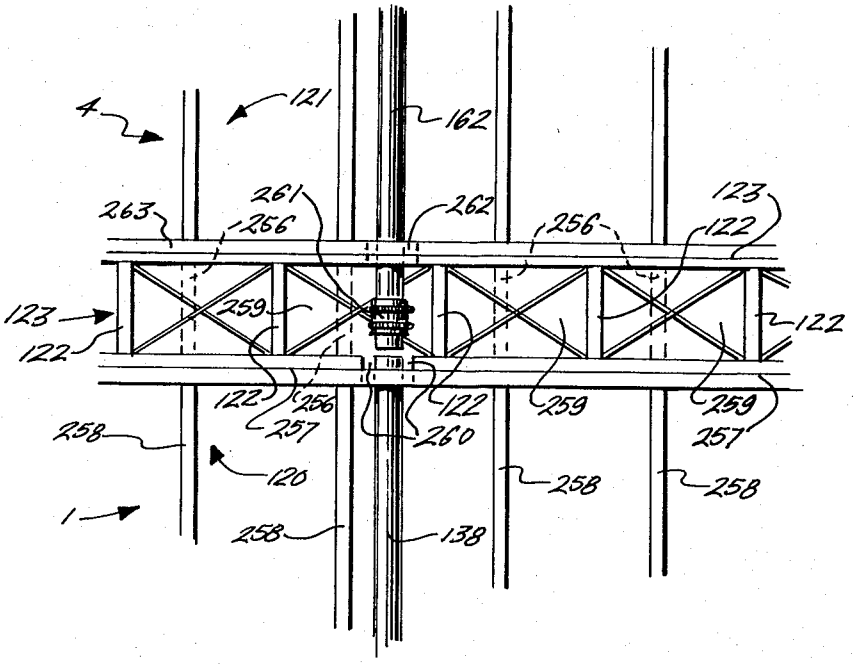
FIG. 37 is a sectional, elevational view illustrating the framing connections shown in FIG. 36 and additionally depicting plumbing connections therein employed.

FIG. 37 is a sectional, elevational view illustrating the framing connections shown in FIG. 36. The relative placement of floor joists 256 above framing studs 258 in lower core wet wall 120 provides structural stability. The staggering of transverse floor joists 122 of middle module base pallet 123 eliminates conflicts when interlocking panelized floor element 23. Metal cross bracing 259 between transverse floor joists 122 of middle module base pallet 123 prevents damage to the frame.

Also shown in FIG. 37 is the plumbing connection between vertical main drain and vent pipe 138 in lower core module 1 and middle core vertical main drain and vent pipe 162. Vertical main drain and vent pipe 138 extends upwardly through lower core wet wall 120 to the upper margin of double top plate 257, which features a connection notch 260 on either side to allow drain and vent pipe connector 261 to slide downwardly from middle core vertical main drain and vent pipe 162 (directly above), thus completing the plumbing line when securely fastened. Middle core vertical main drain and vent pipe 162 is installed during the prefabrication process and extends downwardly within middle core wet wall 121 to the lower margin of middle module base pallet 123. To facilitate the previously described connection, drain and vent pipe connector 261 is installed on middle core vertical main drain and vent pipe 162 upwardly from the intended connection point for subsequent use; and tolerance for vertical alignment is provided by an elliptical hole 262 in base plate 263 of middle core wet wall 121 thus allowing lateral movement.

Figure 38:
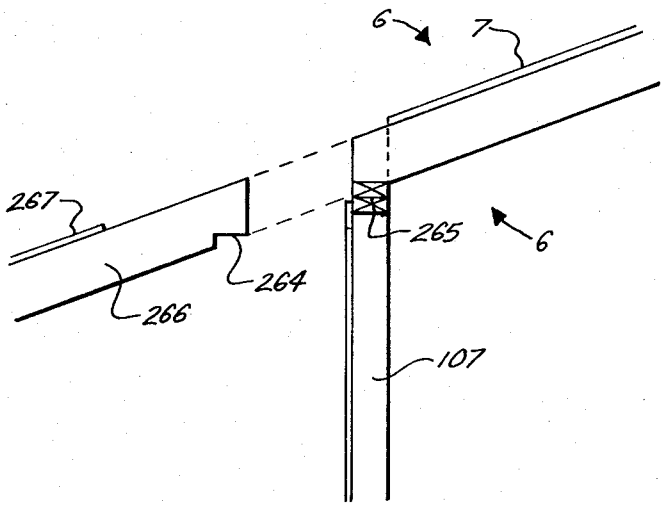
FIG. 38 is a diagrammatic, cross-sectional view of the interconnection of panelized roof elements and the central roof of the upper core module.

FIG. 38 is a diagrammatic cross-section of the interconnection of panelized roof element 29 and central roof 7 of upper core module 6. Inter- connection is accomplished by setting birdsmouth 264 of a plurality of roof rafters 266, each an integral part of panelized roof element 29, in place directly upon upper module double top plate 265 of front attic wall 107. The lower margin of prefabricated central roof 7 of upper core module 6 terminates before an imaginary vertical projection of front attic wall 107, allowing panelized roof element 29 to be freely set in place. Similarly, panelized roof deck 267 of panelized roof element 29 terminates before the upper extremity of roof rafters 266 facilitating fastening in final position. After final placement and fastening of panelized roof element 29, supplemental roof decking 268 is installed between central roof 7 and panelized roof deck 267, thereby completing the planar roof surface. The method of connecting panelized roof element 29 is typical of the system employed to install panelized roof elements 27, 28 and 30.

Figure 39:
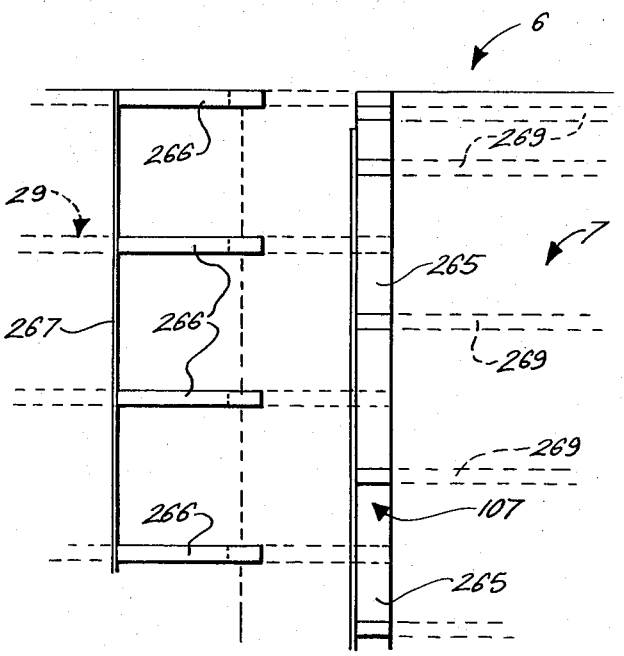
FIG. 39 is plan view of the roof connections shown in FIG. 38.

FIG. 39 is a plan view of the roof framing connections of FIG. 38. The relative placement of the roof rafters 266 of panelized roof element 29 between upper module rafters 269 eleminates conflicts when interlocking panelized roof element 29 with upper core module 6. Thus, after installing panelized roof elements 27, 28 and 30 in similar fashion, the erection process is complete.

What is claimed as invention is:

1. A prefabricated dwelling, having at least two stories comprising:

a. a plurality of prefabricated four-wall non-identical core modules, containing substantilaly all electrical, mechanical and plumbing components necessary to serve said dwelling, said core modules being adapted to be vertically aligned with each other;

b. a base pallet in a lower core module adapted to be received in a preformed monolithic concrete slab, which is provided with a preformed depression to receive said pallet and external utilities connectable with electrical and plumbing lines contained by said core modules;

c. a plurality of pannelized room elements, which interlockingly attach to said core modules to thereby complete said prefabricated dwelling.

2. The apparatus of claim 1, wherein said core modules each comprise a base pallet having an upwardly extending substructure integral thereto, wherein each said substructure cooperates with another of said substructures to form a module superstructure which is received by said concrete slab.

3. The apparatus of claim 2, wherein said panelized room elements interlockingly attach to said superstructure, to thereby complete said prefabricated structure.

4. The apparatus of claim 3, wherein said core modules comprise a lower core module, a middle core module, and an upper core module, wherein said lower core module is received by said concrete slab, said middle core module is vertically aligned with and stacked upon said lower core module, and wherein said upper core module is vertically aligned with and stacked upon said middle core module.

5. The apparatus of claim 4, wherein said upper core module comprises at least a portion of the roof for said structure and a floored attic area.

6. The apparatus of claim 5, wherein said floored attic area contains mechanical equipment for servcing said structure.

7. The apparatus of claim 6, wherein said mechanical equipment comprises, at least in part, air-conditioning and heating equipment for servicing said structure.

8. The apparatus of claim 7, wherein all of said core modules and said panelized room elements have at least one dimension of 8′ to facilitate utilization of standard-size construction materials.

9. The apparatus of claim 1, wherein one of said single, vertical walls formed by said stacked core modules comprises all plumbing connections necessary for water, sewage and drainage service for said structure.

10. The apparatus of claim 1, wherein said preformed trough depression of said concrete slab is of the same height as said base pallet of said lower core module which it receives, thereby providing a uniform floor level for said structure.

11. The apparatus of claim 10, wherein each of said core modules comprise elements of plumbing, electrical and/or mechanical systems which operatively cooperate with each other by means of pipe and duct connections provided at the points of intersection between said modules.

12. The apparatus of claim 11, wherein said base pallet of said lower core module comprises a service chase from which said plumbing system servicing said structure emanates, thus allowing manufacture and preassembly of said plumbing system integrated into said modules at a location remote from the building site.

13. The apparatus of claim 1, wherein said concrete slab further comprises a second preformed trough depression equal in depth to said preformed depression for receiving said lower core module, for facilitating connection of said plumbing system servicing said structure from said base pallet of said lower core module to the exterior of said structure, thereby facilitating completion of said plumbing system after erection of said structure.

14. The apparatus of claim 1, wherein said structure is provided with a staircase comprised of first and second components wherein said first component comprises a first staircase which is prefabricated as an integral part of said lower core module and wherein said second component comprises a second staircase which is separately prefabricated for attachment during the course of erection of said structure, said components thence cooperating to complete said staircase for said structure.

15. The apparatus of claim 14, wherein said floored attic area of said upper core module further contains a hot water heater.

16. The apparatus of claim 15, wherein said lower core module comprises a fully furnished, self-contained kitchen having a corridor for internal circulation.

17. The apparatus of claim 16, wherein said lower core module further comprises a powder room.

18. The apparatus of claim 17, wherein said kitchen contains a refrigerator, an electric range, a double-pan sink, a dishwasher, base cabinets/drawers having countertops, and upper cabinets.

19. The apparatus of claim 18, wherein said powder room contains a toilet and a laboratory.

20. The apparatus of claim 19, wherein said middle core module comprises a full bathroom, laundry facilities, linen closet and chases for air conditioning supply, return air and wiring.

21. The apparatus of claim 20, wherein said bathroom of said middle core module contains a bathtub/shower, a toilet, a vanity base cabinet, a lavoratory mounted within said vanity base cabinet.

22. The apparatus of claim 21, wherein all fixtures and appliances requiring plumbing are located within said lower, middle and upper core modules.

23. The apparatus of claim 22, wherein all of said fixtures and appliances requiring plumbing which have been located within said lower, middle and upper core modules, are further grouped within said lower, middle and upper core modules so as to be aligned vertically and be placed side-by-side horizontally, thus minimizing plumbing complexity.

24. The apparatus of claim 23, wherein said panelized room elements are comprised of at least three different types thereof, including insulated, pre-wired wall, roof and floor room elements.

25. The apparatus of claim 24, wherein said lower, middle, and upper core modules comprise an integrated electrical wiring system which connects with said pre-wired wall elements, to thereby provide electrical utility service to said structure.

26. The apparatus of claim 25, wherein said panelized wall elements are pre-finished on at least one side thereof.

27. The apparatus of claim 27, wherein said lower, middle, and upper core modules comprise a system of ducts which align and operatively cooperate with each other, and which connect to said air-conditioning equipment contained by said floored attic area of said upper core module, thereby providing a pre-fabricated air-conditioning and heating system for said structure, without the necessity of on-site preparation to facilitate installation thereof.

28. The apparatus of claim 27, wherein said insulated, pre-wired wall, roof, and floor room elements interlockingly attach with each other and with said lower, middle, and upper core modules, to thereby form a plurality of rooms adjacent to either side of said lower, middle, and upper core modules.

29. The apparatus of claim 28, wherein said insulated, pre-wired wall room elements comprise perpendicular and parallel types, wherein said perpendicular wall elements interlockingly attach to said lower, middle, and upper core modules, and wherein said parallel wall elements are interconnected between said perpendicular wall elements, to thereby form the exterior walls for said rooms formed by said insulated, pre-wired wall, roof, and floor room elements.

30. The apparatus of claim 29, wherein said insulated, pre-wired floor room elements are comprised of outer and inner elements, wherein said inner and outer floor room elements are interlockingly attached to each other along the lengths thereof, and wherein said floor room elements are interlockingly attached to said lower, middle, and upper core modules on their inner ends, and interlockingly attach to said parallel wall room elements on their outer end, thereby forming the roof/ceiling for the room formed by said wall room elements to which they interlockingly attach, and thereby simultaneously forming the floor for the room subsequently constructed thereabove.

31. The apparatus of claim 30, wherein said base pallets of said lower, middle and upper core modules each comprise a plurality of joists to which said perpendicular wall room elements, said roof room elements and said outer and inner floor room elements interlockingly attach.

32. The apparatus of claim 31, wherein said joists are composed of metal.

33. The apparatus of claim 32, wherein said joists are composed of wood.

34. The apparatus of claim 33, wherein said lower core module comprises an electrical distribution panel and a vertical chase, and wherein said middle and upper core modules comprise second and third vertical chases in alignment with said vertical chase of said lower core module, wherein all of said chases are disposed directly below said mechanical equipment located in said floored, attic area of said upper core module, thereby facilitating the installation of electrical wiring therethrough, to thereby provide electrical utility service to said structure.

35. The apparatus of claim 34, wherein said base pallet of said lower core module comprises a service chase for receiving pre-wired electrical circuits, receptacles, switches, appliances, equipment, lighting, vents, fans, and electrical distribution panels, thus eliminating on-site preparation of electrical utility service systems for said structure.

36. The apparatus of claim 35, wherein said monolithic concrete slab further comprises a third preformed trough depression, having the same height as said trough depression of said slab for receiving said lower core module, for thereby facilitating the connection of electrical wiring from said service chase of said base pallet of said lower core module to the exterior of said structure.

37. The apparatus of claim 1, wherein said core modules extend substantially the width of said structure and said panelized room elements are attached to the front and rear walls of said core modules.

38. A method of constructing a multi-story dwelling, which comprises the steps of:

a. prefabricating a plurality of four-wall non-identical core modules, said modules containing substantially all electrical, mechanical and plumbing components, servicing said dwelling;

b. prefabricating a plurality of panelized, prewired room elements adapted to be interlockingly connected with said core modules to form the dwelling;

c. providing a monolithic concrete slab with preformed depressions to receive a pallet of a lower core module and electrical and plumbing lines for connecting them to external similar utilities;

d. setting said lower core module into said preformed depression in said slab;

e. connecting a middle core module with said lower core module by vertically mounting it atop said lower core module;

f. connecting an upper core module to the middle core module by vertically aligning it and mounting it atop said middle core module;

g. interlockingly attaching said panelized room elements to pallets and joists provided by said core modules;

h. connecting said electrical, mechanical and plumbing lines provided by said core modules to said panelized rooms and to external utilities via lines provided in said preformed depressions in said slab.

* * * * *